US011729867B2

(12) United States Patent
Jeon et al.

(10) Patent No.: US 11,729,867 B2
(45) Date of Patent: Aug. 15, 2023

(54) INDUCTION HEATING TYPE COOKTOP FOR ENABLING HIGH TEMPERATURE DETECTION

(71) Applicant: LG Electronics Inc., Seoul (KR)

(72) Inventors: Seonho Jeon, Seoul (KR); Seongho Son, Seoul (KR); Younghwan Kwack, Seoul (KR); Chuhyoung Cho, Seoul (KR); Jongseong Ji, Seoul (KR)

(73) Assignee: LG Electronics Inc., Seoul (KR)

( * ) Notice: Subject to any disclaimer, the term of this patent is extended or adjusted under 35 U.S.C. 154(b) by 459 days.

(21) Appl. No.: 16/849,584

(22) Filed: Apr. 15, 2020

(65) Prior Publication Data

US 2021/0195699 A1 Jun. 24, 2021

(30) Foreign Application Priority Data

Dec. 18, 2019 (KR) ..... 10-2019-0169905

(51) Int. Cl.

| | |
|---|---|
| ***F24C 15/10*** | (2006.01) |
| ***H05B 1/02*** | (2006.01) |
| ***H05B 6/10*** | (2006.01) |
| ***H05B 6/12*** | (2006.01) |
| ***H05B 6/06*** | (2006.01) |

(52) U.S. Cl.

CPC ..... *H05B 6/062* (2013.01); *F24C 15/104* (2013.01); *F24C 15/105* (2013.01); *H05B 1/0266* (2013.01); *H05B 6/1245* (2013.01); *H05B 2213/07* (2013.01)

(58) Field of Classification Search

CPC .... H05B 6/062; H05B 6/1209; H05B 6/1245; H05B 6/1254; H05B 1/0266; H05B 2213/07; F24C 15/104; F24C 15/105; G01K 7/02

See application file for complete search history.

(56) References Cited

U.S. PATENT DOCUMENTS

| | | | |
|---|---|---|---|
| 6,633,023 | B2 | 10/2003 | Cornec et al. |
| 6,770,857 | B2 | 8/2004 | Hirota et al. |
| 7,081,603 | B2 | 7/2006 | Hoh et al. |

(Continued)

FOREIGN PATENT DOCUMENTS

| | | | | |
|---|---|---|---|---|
| CN | 109068427 | | 12/2018 | |
| DE | 10127051 | | 12/2002 | |
| DE | 10127051 | A1 * | 12/2002 | ..... H05B 6/1209 |

(Continued)

OTHER PUBLICATIONS

Extended European Search Report in International Appln. No., 201799558, dated Nov. 12, 2020, 10 pages.

*Primary Examiner* — William J Levicky
*Assistant Examiner* — Bryan M Badalamenti
(74) *Attorney, Agent, or Firm* — Fish & Richardson P.C.

(57) ABSTRACT

An induction heating type cooktop includes an upper plate coupled to a top side of a case and configured to place an object to be heated on a top of the upper plate, a working coil disposed inside the case to heat the object, a thin film disposed on at least one of a top surface or a bottom surface of the upper plate, an insulator disposed between the bottom surface of the upper plate and the working coil, and a temperature sensor configured to measure a temperature of at least one of the thin film or the upper plate by a plurality of thermocouples.

20 Claims, 19 Drawing Sheets

(56) References Cited

U.S. PATENT DOCUMENTS

| | | | | |
|---|---|---|---|---|
| 2005/0205561 | A1 | 9/2005 | Keishima et al. | |
| 2012/0138596 | A1 * | 6/2012 | Alonso Esteban | ..... C03C 17/36 219/600 |

FOREIGN PATENT DOCUMENTS

| | | | | |
|---|---|---|---|---|
| EP | 1487239 | | 12/2004 | |
| EP | 1536669 | | 5/2006 | |
| EP | 2876373 | A1 * | 5/2015 | ..... F24C 15/107 |
| EP | 3270660 | | 1/2018 | |
| JP | 2002056959 | | 2/2002 | |
| JP | 3496558 | | 2/2004 | |
| JP | 2008311058 | | 12/2008 | |
| JP | 2009283205 | | 12/2009 | |
| JP | 2012054105 | | 3/2012 | |
| JP | 5630495 | | 11/2014 | |
| WO | WO-2019129552 | A1 * | 7/2019 | ..... A24F 40/465 |

* cited by examiner

INDUCTION HEATING TYPE COOKTOP FOR ENABLING HIGH TEMPERATURE DETECTION

CROSS-REFERENCE TO RELATED APPLICATION

This application claims the benefit of Korean Patent Application No. 10-2019-0169905, filed on Dec. 18, 2019, the disclosure of which is incorporated herein in its entirety by reference.

TECHNICAL FIELD

The present disclosure relates to detecting a temperature in an induction heating type cooktop.

BACKGROUND

Various types of cookware are used to cook food at home or at restaurants. For example, gas ranges may use gas as fuel to heat food. In some cases, cooking devices may heat a target heating object such as a pot and a cooking vessel using electricity rather than gas.

Methods for heating a target heating object using electricity may be divided into a resistance heating method and an induction heating method. In the electric resistance heating method, a target heating object may be heated by heat that is generated when a current flows in a metal resistance wire or a non-metallic heating element such as Silicon Carbide (SIC) and transferred to the target heating object (e.g., a cooking vessel) through heat dissipation or heat transfer. In the induction heating method, a target heating object may be heated by an eddy current generated in the target heating object made of a metal material using an electrical field that is generated around a coil when a high frequency power having a predetermined magnitude is applied to the coil.

The induction heating method may be applied to cooktops.

In some cases, a cooktop using an induction heating method may only heat an object made of a magnetic material. For example, when an object made of a nonmagnetic material (for example, heat-resistant glass, porcelain, etc.) is disposed on the cooktop, the cooktop may not heat the nonmagnetic material object.

In some cases, an induction heating device may include a heating plate disposed between a cooktop and a nonmagnetic object to heat the object. In some cases, a heating efficiency may be low, and a cooking time to heat ingredients contained in the target heating object may be increased.

In some cases, a hybrid cooktop may heat a nonmagnetic object through a radiant heater using an electric resistance heating method, where a magnetic object is heated through a working coil by induction. In some cases, an output of the radiant heater may be low, and a heating efficiency may be low. A user may feel inconvenience in considering a material of a target heating object when placing the target heating object in the heating area.

In some cases, an all metal cooktop may heat a metal object (e.g., a nonmagnetic metal and a magnetic object). However, the all metal cooktop may not heat a nonmagnetic and non-metallic object. In addition, a heating efficiency may be lower than a radiant heater technology, and a material cost may be high.

In some cases, an induction heating type cooktop in related art may not heat a target heating object to a certain temperature or higher (e.g., 300° C. or higher) as a cooking vessel is directly heated by induction. Thus, in some cases, the induction heating type cooktop in related art may include a temperature sensor (e.g., a thermistor) that is configured to measure a temperature of the target heating object within an anticipated temperature range.

For example, the thermistor may measure a temperature based on a resistance value that appears in an output of the sensor as the electric resistance is converted depending on the temperature. Due to device characteristics of the temperature sensor, the resistance value dependent on the temperature may not vary greatly when the temperature is 100° C. or higher. In some cases, each thermistor may include an additional circuit (e.g., a resistance converting circuit) to distribute a resistance value in order to differentiate temperatures. Furthermore, each thermistor as a temperature sensor may have a delay time (a thermal time constant) until a sensed temperature value becomes equal to an actual temperature value.

In some cases, the cooktop in related art may further include an additional thin film (or, thin layer, hereinafter referred as thin film) capable of being inductively heated. For example, the cooktop may heat a magnetic cooking vessel which is capable of being inductively heated and may use heat transferred from the thin film inductively heated to thereby heat a cooking vessel which is not capable of being directly inductively heated. In some cases, where a cooking vessel is not inductively heated, a heat transferring efficiency may decrease compared to an example where a cooking vessel is directly heated. Therefore, the thin film to be inductively heated may need to be heated up to a temperature (e.g., 600° C.) relatively higher than a temperature of the cooking vessel to be directly inductively heated.

In some cases, where the cooktop may directly and inductively heat not only a cooking vessel but also a thin film, the temperature of the thin film may be increased fast when it is heated approximately to 600° C. or higher by induction. In this case, if a thermistor has a delay time to precisely measure a temperature is used, a difference in an error scale at the time of measurement may be large, which may lead to a damage to a component in the cooktop.

In some cases, the cooktop may determine an eccentricity (i.e., offset) of a cooking vessel based on an electrical parameter. If high temperature heating is performed only at a certain portion due to the eccentricity of the cooking vessel, the cooktop may be damaged. Therefore, it may be necessary to accurately detect the eccentricity of the cooking vessel and control an output based on the sensing result for stable use of the cooktop.

In some cases, a cooktop including a thin film may have difficulty in determining an eccentricity of a metal cooking vessel based on a variation of an electrical parameter. When the thin film is heated to a high temperature, a capability of sensing eccentricity of a cooking vessel may be an essential function of a cooktop including the thin film. In some cases, where the cooktop heats various materials using a thin film and has a small variation of an electrical parameter, it may be difficult to utilize the variation of the electrical parameter in determining an eccentricity of the cooking vessel.

SUMMARY

The present disclosure describes an induction heating type cooktop capable of heating both a magnetic object and a nonmagnetic object.

The present disclosure describes an induction heating type cooktop including a thin film capable of being inductively heated to a high temperature, thereby preventing damage of an upper plate.

The present disclosure describes an induction heating type cooktop including a temperature sensor that is configured to rapidly measure a temperature of a thin film being inductively heated fast and that has a wide range of measurement of temperature, thereby preventing damage of an upper plate due to the thin film inductively heated to a high temperature.

The present disclosure describes an induction heating type cooktop capable of performing a temperature control adaptively with a position of a cooking vessel and a heated temperature based on a temperature of at least one of a thin film or an upper plate. The temperature may be acquired by a temperature sensor that is configured to rapidly measure a temperature of a thin film being inductively heated and that has a wide range of measurement of temperature.

The present disclosure describes an induction heating type cooktop having a thin film capable of being inductively heated and a temperature sensor configured to rapidly and precisely measure a temperature of the thin film so as to determine whether a cooking vessel is placed on an upper plate, thereby enabling a temperature control adaptively with the position of the cooking vessel.

Objects of the present disclosure are not limited thereto, and other objects and advantages of the present disclosure will be understood by the following description, and will become more apparent from implementations of the present disclosure. Furthermore, the objects, features and advantages of the present disclosure can be realized by means disclosed in the accompanying claims or combination thereof.

According to one aspect of the subject matter described in this application, an induction heating type cooktop includes an upper plate coupled to a top side of a case and configured to place an object to be heated on a top of the upper plate, a working coil disposed inside the case to heat the object, a thin film disposed on at least one of a top surface or a bottom surface of the upper plate, an insulator disposed between the bottom surface of the upper plate and the working coil, and a temperature sensor configured to measure a temperature of at least one of the thin film or the upper plate by a plurality of thermocouples.

Implementations according to this aspect may include one or more of the following features. For example, the temperature sensor may be further configured to, based on the thin film being inductively heated, measure a first temperature of a portion of the at least one of the thin film or the upper plate. The first temperature may be greater than or equal to a predetermined temperature in the temperature distribution in the thin film.

In some examples, the plurality of thermocouples may be disposed at regions corresponding to the thin film on the at least one of the top surface or the bottom surface of the upper plate. In some examples, the plurality of thermocouples may include at least one thermocouple that is disposed at a region corresponding to the thin film and that may be configured to measure a temperature of the thin film, and at least one thermocouple that is disposed at a region outside the thin film.

In some implementations, the induction heating type cooktop may further include a controller configured to control the working coil, and each of the plurality of thermocouples may include a first end that is connected to the at least one of the thin film or the upper plate, and a second end that may be configured to transfer an electromotive force to the controller. In some examples, the first end may pass through the insulator and be attached to the at least one of the thin film or the upper plate.

In some implementations, the controller may be configured to measure a temperature of a thermocouple that is selected among the plurality of thermocouples based on a selection signal. In some examples, the induction heating type cooktop may further include a multiplexer that may be configured to receive the selection signal, that may be configured to select the thermocouple based on the selection signal, and that may be configured to switch the selection of the thermocouple among the plurality of thermocouples based on a predetermined cycle, and an amplifying circuit that may be configured to amplify an electromotive force generated in the thermocouple that is selected by the multiplexer. The controller may be further configured to receive information regarding the temperature of the selected thermocouple through the amplifying circuit.

In some implementations, the controller may be further configured to control an output of the working coil based on whether at least one of temperatures measured by the plurality of thermocouples exceeds a predetermined temperature threshold. In some examples, the controller may be further configured to, based on the at least one of the temperatures exceeding the predetermined temperature threshold, determine that a central portion of the object may be offset from a central portion of the working coil.

In some implementations, the controller may be further configured to, based on a determination that the central portion of the object may be offset from the central portion of the working coil, control the output of the working coil to be less than or equal to a preset output. In some implementations, the controller may be further configured to, based on the at least one of the temperatures being less than or equal to the predetermined temperature threshold, maintain the output of the working coil.

In some implementations, the controller may be further configured to output a predetermined guide message based on a determination that the central portion of the object may be offset from the central portion of the working coil. In some examples, the controller may be further configured to determine whether at least one of differences between the temperatures measured by the plurality of thermocouples exceeds a predetermined difference threshold and to output the predetermined guide message based on a determination that at least one of differences between the temperatures measured by the plurality of thermocouples exceeds the predetermined difference threshold.

In some implementations, the plurality of thermocouples may be K-type thermocouples. In some implementations, a thickness of the thin film may be less than a skin depth of the thin film.

In some implementations, the thin film may have a ring shape having a central area that exposes the upper plate, and the plurality of thermocouples may include a first thermocouple connected to the thin film and a second thermocouple connected to the upper plate corresponding to the central area of the thin film. In some examples, each of the first thermocouple and the second thermocouple may pass through the insulator.

In some implementations, the thin film may include a first thin film attached to the top surface of the upper plate and a second thin film attached to the bottom surface of the upper plate, and the plurality of thermocouples may include an upper thermocouple connected to the first thin film and a lower thermocouple connected to the second thin film. In some examples, the first thin film and the second thin film may have concentric ring shapes having different diameters, and each of the upper thermocouple and the lower thermocouple may pass through the insulator.

In some implementations, a thin film may be disposed at an upper plate and inductively heated fast to a high temperature. It may be possible to rapidly and precisely measure a temperature using thermocouples.

In some implementations, to minimize damage to an upper plate due to eccentricity of a target heating object (e.g., a cooking vessel), the cooktop may rapidly and precisely measure a temperature using a plurality of thermocouples, recognize the eccentricity of the cooking vessel, and perform an output control accordingly.

BRIEF DESCRIPTION OF THE DRAWINGS

The above and other aspects, features, and advantages of certain implementations will be more apparent from the following detailed description taken in conjunction with the accompanying drawings.

DETAILED DESCRIPTION

Figure 1:
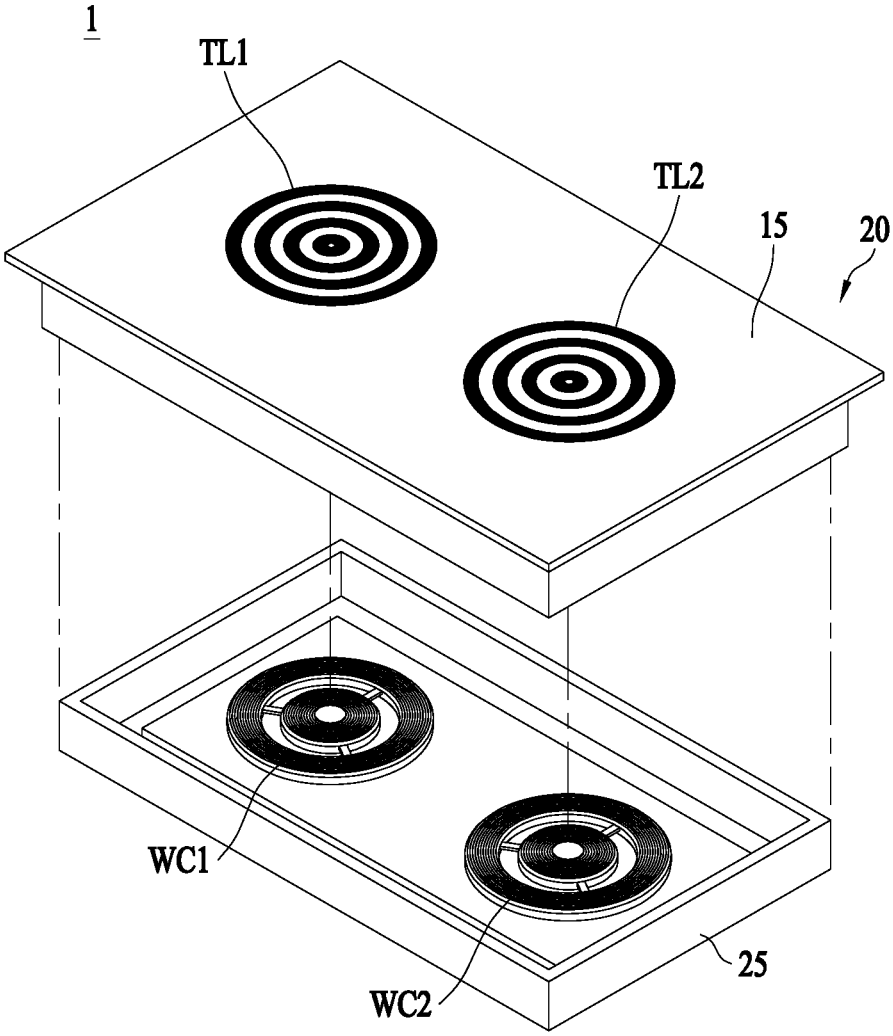
FIG. 1 is a diagram illustrating an example of an induction heating type cooktop.

Hereinafter, implementations of the present disclosure will be described in detail with reference to the drawings so that those skilled in the art to which the present disclosure pertains can easily perform the present disclosure. The present disclosure may be implemented in many different forms and is not limited to the implementations described herein.

In order to illustrate this application, a part that is not related to the description may be omitted, and the same or similar components are denoted by the same reference numerals throughout the specification. Further, some implementations of this application will be described in detail with reference to exemplary drawings. In adding the reference numerals to the components of each drawing, the same components may have the same sign as possible even if they are displayed on different drawings. Further, in describing this application, when it is determined that a detailed description of a related known configuration and a function may obscure the gist of this application, the detailed description thereof will be omitted.

Further, in implementing the present disclosure, for convenience of explanation, components may be described by being subdivided; however, these components may be implemented in a device or a module, or a single component may be implemented by being divided into a plurality of devices or modules.

Hereinafter, an induction heating type cooktop in some implementations will be described.

FIG. 1 is a diagram illustrating an induction heating type cooktop.

Referring to FIG. 1, an induction heating type cooktop 1 in some implementations may include a case 25, a cover plate 20, working coils WC1 and WC2 (that is, first and second working coils), and thin films TL1 and TL2 (that is, first and second thin films).

The working coils WC1 and WC2 may be installed in the case 25.

In some implementations, the cook top may include various devices related to driving of a working coil other than the working coils WC1 and WC2 in the case 25. For example, the devices relating to driving of a working coil may include a power part for providing alternating current power, a rectifying part for rectifying alternating current power from the power part to direct current power, an inverter part for inverting the direct power rectified by the rectifying part to a resonance current through a switching operation, a control part for controlling operations of various devices in the induction heating type cooktop 1, a relay or a semi-conductor switch for turning on and off a working coil, and the like. Regarding this, a detailed description will be herein omitted.

The cover plate 20 may be coupled to a top of the case 25, and an upper plate 15 for placing a target heating object may be provided in the top.

Specifically, the cover plate 20 may include the upper plate 15 for placing a target heating object, such as a cooking vessel.

The upper plate may be, for example, formed of a glass material (e.g., ceramic glass).

In some examples, an input interface may be provided in the upper plate 15 to receive an input from a user and transfer the input to a control part that serves as an input interface. The input interface may be provided at a position other than the upper plate 15.

The input interface may allow a user to input a desired heat intensity or an operation time of the induction heating type cooktop 1. The input interface may be implemented in various forms, such as a mechanical button or a touch panel. In addition, the input interface may include, for example, a power button, a lock button, a power control button (+, −), a timer control button (+, −), a charging mode button, and the like. The input interface may transfer an input provided by a user to a control part for the input interface, and the control part for the input interface may transfer the input to the aforementioned control part (that is, a control part for an inverter). The aforementioned control part may control operations of various devices (e.g., a working coil) based on an input (that is, a user input) provided from the control part for the input interface, and a detailed description thereof will be omitted. In some examples, the control part may include or be connected to a controller, an electric circuit, a processor, or the like.

In some examples, in the upper plate 15, whether the working coils WC1 and WC2 are being driven or not and an intensity of heating (that is, thermal power) may be visually displayed in a fire hole shape. The fire hole shape may be displayed by an indicator that includes a plurality of light emitting devices (e.g., light emitting diodes (LEDs)) provided in the case 25.

The working coils WC1 and WC2 may be installed inside the case 25 to heat a target heating object.

Specifically, driving of the working coils WC1 and WC2 may be controlled by the aforementioned control part. When the target heating object is positioned on the upper plate 15, the working coils WC1 and WC2 may be driven by the control part.

In some examples, the working coils WC1 and WC2 may directly heat a magnetic target heating object (that is, a magnetic object) and may indirectly heat a nonmagnetic target heating object (that is, a nonmagnetic object) through the thin films TL1 and TL2 which will be described in the following.

The working coils WC1 and WC2 may heat a target heating object by employing an induction heating method and may be provided to overlap the thin films TL1 and TL2 in a longitudinal direction (that is, a vertical direction or an up-down direction).

Although FIG. 1 illustrates that two working coils WC1 and WC2 are installed in the case 25, but aspects of the present disclosure are not limited thereto. For example, one working coil or three or more working coils may be installed in the case 25. Yet, for convenience of explanation, an example in which two working coils WC1 and WC2 are installed in the case 25 will be described.

The thin films TL1 and TL2 may be coated on the upper plate 15 to heat a nonmagnetic object among target heating objects.

Specifically, the thin films TL1 and TL2 may be coated on a top surface or a bottom surface and may be provided to overlap the working coils WC1 and WC2 in a longitudinal direction (that is, a vertical direction or an up-down direction). Accordingly, it is possible to heat the corresponding target heating object, regardless of a position and a type of the target heating object.

The thin films TL1 and TL2 may have at least one of a magnetic property and a nonmagnetic property (that is, either or both of the magnetic property and the nonmagnetic property).

The thin films TL1 and TL2 may be, for example, formed of a conductive material (e.g., aluminum). As illustrated in the drawing, the thin films TL1 and TL2 may be coated on a top surface of the upper plate 15 by taking the form of a plurality of rings having different diameters. However, aspects of the present disclosure are not limited thereto.

That is, the thin films TL1 and TL2 may include a material other than a conductive material and may be coated on the upper plate 15 by taking a different form. Yet, for convenience of explanation, an example in which the thin films TL1 and TL2 is formed of a conductive material and coated on the upper plate 15 in the form of a plurality of rings having different diameters will be described.

FIG. 1 shows two thin films TL1 and TL2, but aspects of the present disclosure are not limited thereto. That is, one thin film or three or more thin films may be coated. Yet, for convenience of explanation, an example in which two thin films TL1 and TL2 are coated will be described.

However, FIG. 1 is a diagram illustrating an exemplary dispositional relationship between elements used in the present disclosure. Therefore, shapes, numbers, and positions of the elements should not be construed as being limited to the example shown in FIG. 1.

The thin films TL1 and TL2 will be later described in more detail.

Figure 2:
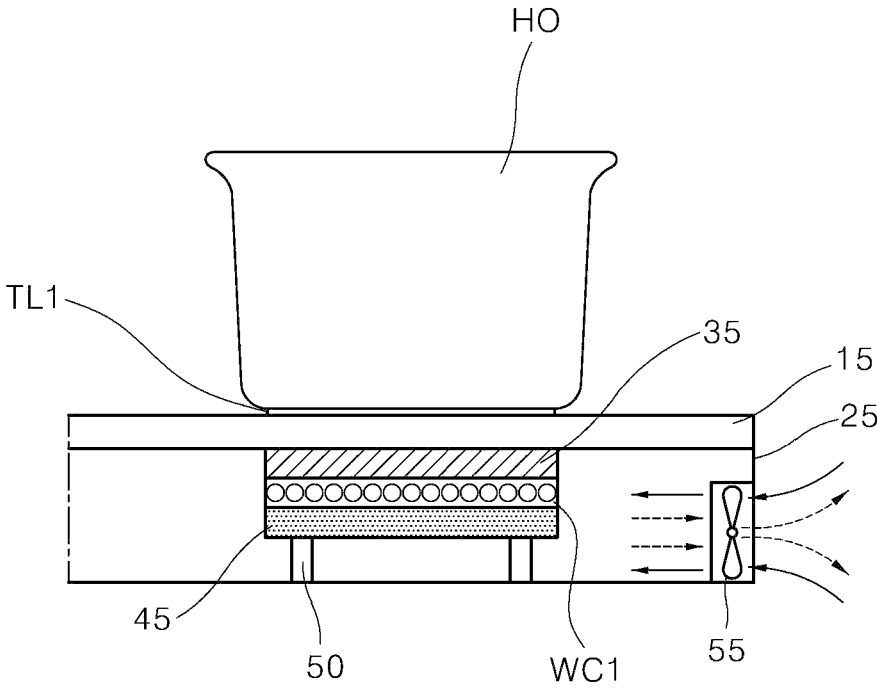
FIG. 2 is a diagram illustrating example elements disposed inside an example case of the induction heating type cooktop shown in FIG. 1.

FIG. 2 is a diagram illustrating elements provided inside a case of the induction heating type cooktop shown in FIG. 1.

Referring to FIG. 2, the induction heating type cooktop 1 in some implementations may further include an insulator 35, a shield plate 45, a support member 50, and a cooling fan 55.

Since elements disposed in the surroundings of a first working coil WC1 are identical to elements disposed in the surroundings of a second working coil WC2, the elements (e.g., the first thin film TL1, the insulator 35, the shield plate 45, the support member 50, and the cooling fan 55) in the surroundings of the first working coil WC1 will be hereinafter described for convenience of explanation.

The insulator 35 may be provided between a bottom surface of the upper plate 15 and the first working coil WC1.

Specifically, the insulator 35 may be mounted to the cover plate 20, that is, the bottom of the upper plate 15. The first working coil WC1 may be disposed below the insulator 35.

The insulator 35 may block heat, which is generated when the first thin film TL1 or a target heating object HO is heated upon driving of the first working coil WC1, from being transferred to the first working coil WC1.

That is, when the first thin film TL1 or the target heating object HO is heated by electromagnetic induction of the first working coil WC1, heat of the first thin film TL1 or the target heating object HO may be transferred to the upper plate 15 and the heat transferred to the upper plate 15 may be transferred to the first working coil WC1, thereby possibly causing damage to the first working coil WC1.

By blocking the heat from being transferred to the first working coil WC1, the insulator 35 may prevent damage of the first working coil WC1 caused by the heat and furthermore prevent degradation of heating performance of the first working coil WC1.

In some examples, a spacer may be installed between the first working coil WC1 and the insulator 35.

Specifically, the spacer may be inserted between the first working coil WC1 and the insulator 35, so that the first working coil WC1 and the insulator 35 may not directly contact each other. Accordingly, the spacer may block heat, which is generated when the first thin film TL1 and the target heating object HO are heated upon driving of the first working coil WC1, from being transferred to the first working coil WC1 through the insulator 35.

That is, since the spacer may share the role of the insulator 35, it is possible to minimize a thickness of the insulator 35 and accordingly minimize a gap between the target heating object HO and the first working coil WC1.

In addition, a plurality of spacers may be provided, and the plurality of spaces may be disposed to be spaced apart from each other in the gap between the first working coil WC1 and the insulator 35. Accordingly, air suctioned into the case 25 by the cooling fan 55 may be guided to the first working coil WC1 by the spacer.

That is, the spacer may guide air, introduced into the case 25 by the cooling fan 55, to be properly transferred to the first working coil WC1, thereby improving cooling efficiency of the first working coil WC1.

The shield plate 45 may be mounted to a bottom of the first working coil WC1 to block a magnetic field occurring downwardly upon driving of the first working coil WC1.

Specifically, the shield plate 45 may block the magnetic field occurring downwardly upon driving of the first working coil WC1 and may be supported upwardly by the support member 50.

The support member 50 may be installed between a bottom surface of the shield plate 45 and a bottom surface of the case 25 to support the shield plate 45 upwardly.

Specifically, by supporting the shield plate 45 upwardly, the support member 50 may indirectly support the insulator 35 and the first working coil WC1 upwardly. In doing so, the insulator 35 may be brought into tight contact with the upper plate 15.

As a result, it is possible to maintain a constant gap between the first working coil WC1 and the target heating object HO.

The support member 50 may include, for example, an elastic object (e.g., a spring) to support the shield plate 45 upwardly, but aspects of the present disclosure are not limited thereto. In some examples, the support member 50 may be omitted from the induction heating type cooktop 1.

The cooling fan 55 may be installed inside the case 25 to cool the first working coil WC1.

Specifically, driving of the cooling fan 55 may be controlled by the aforementioned control part and the cooling fan 55 may be installed at a side wall of the case 25. The cooling fan 55 may be installed at a position other than the side wall of the case 25. In an implementation, for convenience of explanation, an example in which the cooling fan 55 is installed at the side wall of the case 25 will be described.

The cooling fan 55 may suction outdoor air from the outside of the case 25, as shown in FIG. 2, and transfer the suctioned air to the first working coil WC1. The cooling fan 55 may suction indoor air (especially heated air) of the case 25 and discharge the suctioned air to the outside of the case 25.

In doing so, it is possible to efficiently cool internal elements (especially the first working coil WC1) of the case 25.

In addition, as described above, the outdoor air transferred from the outside of the case 25 to the first working coil WC1 by the cooling fan may be guided to the first working coil WC1 by the spacer. Accordingly, it is possible to directly and efficiently cool the first working coil WC1, thereby improving endurance of the first working coil WC1 (which means that it is possible to improve the endurance by preventing thermal damage).

As such, the induction heating type cooktop 1 in some implementations may have the above-described features and configurations. Hereinafter, features and configurations of the aforementioned thin film will be described in more detail with reference to FIGS. 3 to 6.

Figure 3:
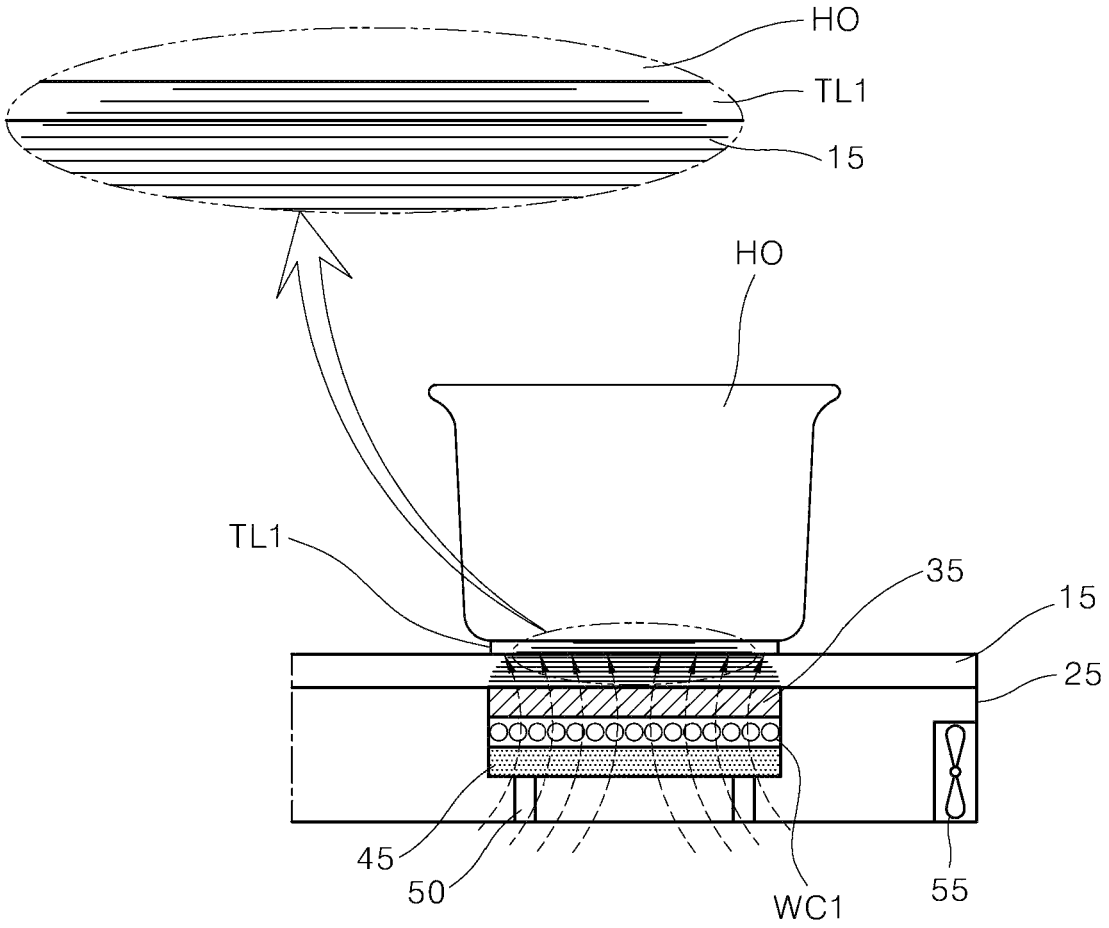
FIGS. 3 and 4 are diagrams illustrating examples of a relation between a thickness and a skin depth of a thin film.
Figure 4:
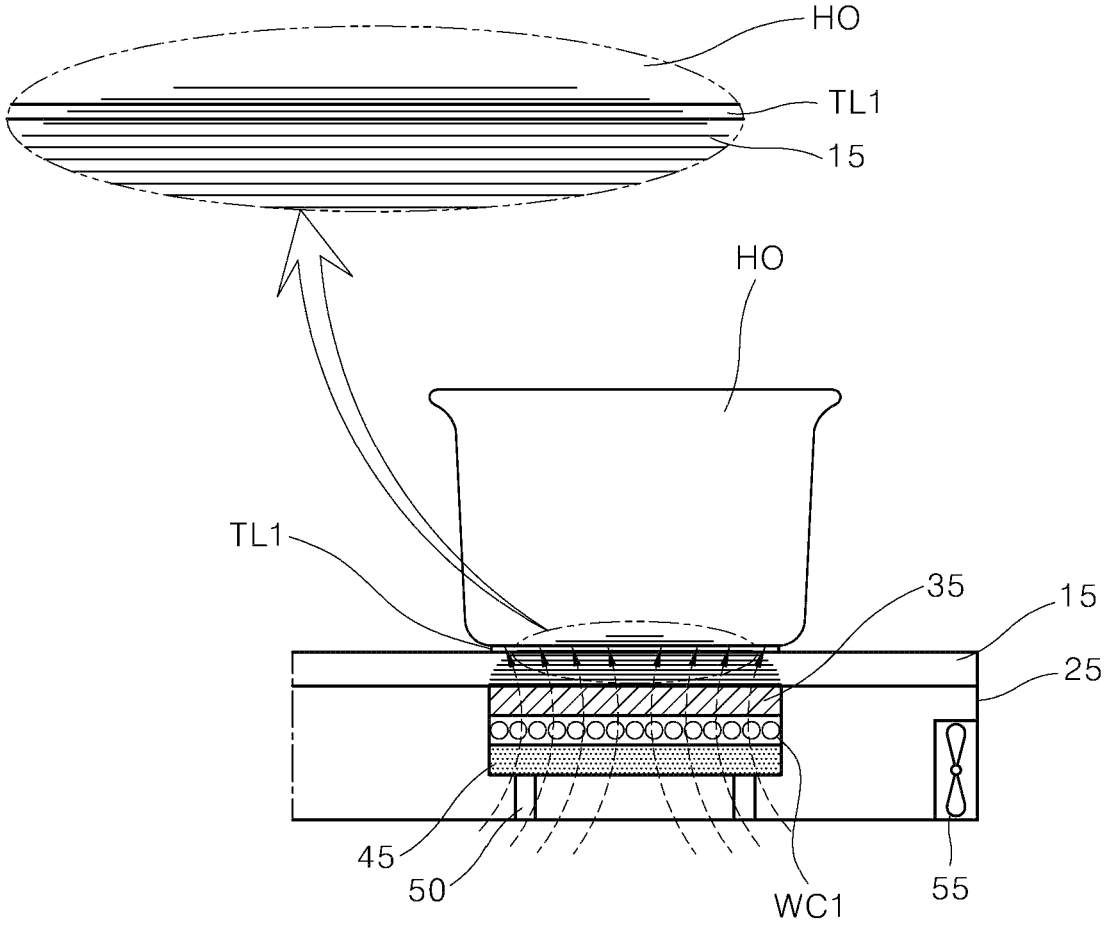
Figure 5:
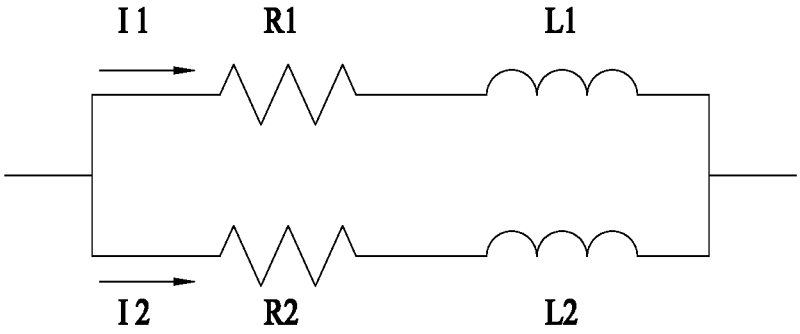
FIGS. 5 and 6 are diagrams illustrating examples of a variation of an impendence between a thin film and a target heating object depending on a type of the target heating object.
Figure 6:
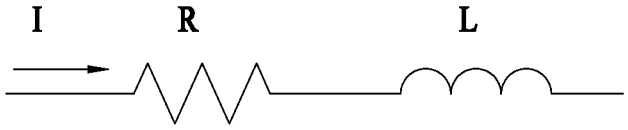

FIGS. 3 and 4 are diagrams illustrating examples of a relation between a thickness and a skin depth of a thin film. FIGS. 5 and 6 are diagrams illustrating examples of a variation of impendence between a thin film and a target heating object depending on a type of the target heating object.

The first thin film TL1 and the second thin film TL2 have the same technical features, and the thin film TL1 and TL2 may be coated on the top surface or the bottom surface of the upper plate 15. Hereinafter, for convenience of explanation, the first thin film TL1 coated on the top surface of the upper plate 15 will be described as an example.

The first thin film TL1 has the following features.

In some examples, the first thin film TL1 may include a material having a low relative permeability.

Specifically, since the first thin film TL1 has a low relative permeability, the skin depth of the first thin film TL1 may be deep. The skin depth may refer to a depth by which a current can penetrate a material surface, and the relative permeability may be disproportional to the skin depth. Accordingly, the lower the relative permeability of the first thin film TL, the deeper the skin depth of the first thin film TL1.

In addition, the skin depth of the first thin film TL1 may have a value greater than a value corresponding to a thickness of the first thin film TL1. That is, since the first thin film TL1 has a thin thickness (e.g., a thickness of 0.1 μm-1,000 μm) and a skin depth of the first thin film TL1 is greater than the thickness of the first thin film TL1, a magnetic field occurring by the first working coil WC1 may pass through the first thin film TL1 and be then transferred to the target heating object HO. As a result, an eddy current may be induced to the target heating object HO.

That is, as illustrated in FIG. 3, when the skin depth of the first thin film TL1 is narrower than the thickness of the first thin film TL1, it is difficult for the magnetic field occurring by the first working coil WC1 to reach the target heating object HO.

In some implementations, as illustrated in FIG. 4, when the skin depth of the first skin depth TL1 is deeper than the thickness of the first thin film TL1, most of the magnetic field generated by the first working coil WC1 may be transferred to the target heating object HO. In some examples, where the skin depth of the first thin film TL1 is deeper than the thickness of the first thin film TL1, the magnetic field generated by the first working coil WC1 may pass through the first thin film TL1 and most of the magnetic field energy may be dissipated in the target heating object HO. In doing so, the target heating object HO may be heated primarily.

Since the first thin film TL1 has a thin thickness as described above, the thin film TL1 may have a resistance value that allows the first thin film TL1 to be heated by the first working coil WC1.

Specifically, the thickness of the first thin film TL1 may be disproportional to the resistance value of the first thin film TL1 (that is, a sheet resistance value). That is, the thinner the thickness of the first thin film TL1 coated on the upper plate 15, the greater the resistance value (that is, the sheet resistance) of the first thin film TL1. As thinly coated on the upper plate 15, the first thin film TL1 may change in property to a load resistance at which heating is possible.

The first thin film TL1 may have, for example, a thickness between 0.1 μm and 1,000 μm, but not limited thereto.

The first thin film TL1 having the above-described characteristic is present to heat a nonmagnetic object, and thus, an impedance property between the first thin film TL1 and the target heating object HO may vary according to whether the target heating object HO positioned at the top of the upper plate 15 is a magnetic object or a nonmagnetic object.

First, the case where the target heating object is a magnetic object will be described in the following.

Referring to FIGS. 2 and 5, when the first working coil WC1 is driven while a magnetic target heating object HO is positioned at the top of the upper plate 15, a resistance component R1 and an inductor component L1 of the magnetic target heating object HO may form an equivalent circuit to that of a resistance component R2 and an inductor component L2 of the first thin film TL1.

In this case, in the equivalent circuit, an impedance (that is, an impedance of R1 and L1) of the magnetic target heating object HO may be smaller than an impedance (that is, an impedance of R2 and L2) of the first thin film TL1.

Accordingly, when the aforementioned equivalent circuit is formed, the magnitude of an eddy current I1 applied to the magnetic target heating object HO may be greater than the magnitude of an eddy current I2 applied to the first thin film TL1. More specifically, most of eddy currents may be applied to the target heating object HO, thereby heating the target heating object HO.

That is, when the target heating object HO is a magnetic object, the aforementioned equivalent circuit may be formed and most of eddy currents may be applied to the target heating object HO. Accordingly, the first working coil WC1 may directly heat the target heating object HO.

Since some of eddy currents is applied even to the first thin film TL1, the first thin film TL1 may be heated slightly. Accordingly, the target heating object HO may be indirectly heated to a certain degree by the thin film TL1. However, a degree to which the target heating object HO is heated indirectly by the first thin film TL1 may not be considered significant, as compared with a degree to which the target heating object HO is heated directly by the first working coil WC1.

One or more examples where a target heating object is a nonmagnetic object will be described in the following.

Referring to FIGS. 2 and 6, when the working coil WC1 is driven while a nonmagnetic target heating object HO is positioned at the top of the upper plate 15, an impedance may not exist in the nonmagnetic target heating object HO but exists in the first thin film TL1. That is, a resistance component R and an inductor component L may exist only in the first thin film TL1.

Accordingly, an eddy current I may be applied only to the first thin film TL1 and may not be applied to the nonmagnetic target heating object HO. More specifically, the eddy current I may be applied only to the first thin film TL1, thereby heating the first thin film TL1.

That is, when the target heating object HO is a nonmagnetic object, the eddy current I may be applied to the first thin film TL1, thereby heating the first thin film TL1. Accordingly, the nonmagnetic target heating object HO may be indirectly heated by the first thin film TL1 that is heated by the first working coil WC1.

To put it briefly, regardless of whether the target heating object HO is a magnetic object or a nonmagnetic object, the target heating object HO may be heated directly or indirectly by a single heating source which is the first working coil WC1. That is, when the target heating object HO is a magnetic object, the first working coil WC1 may directly heat the target heating object HO, and, when the target heating object HO is a nonmagnetic object, the first thin film TL1 heated by the first working coil WC1 may indirectly heat the target heating object HO.

As described above, the induction heating type cooktop 1 in some implementations may be capable of heating both a magnetic object and a nonmagnetic object. Thus, the induction heating type cooktop 1 in some implementations may be capable of heating a target heating object regardless of a position and a type of the target heating object. Accordingly, without determining whether the target heating object is a magnetic object or a nonmagnetic object, a user is allowed to place the target heating object in any heating region on the top plate, and therefore, convenience of use may improve.

In addition, the induction heating type cooktop 1 in some implementations may directly or indirectly heat a target heating object using the same heating source, and therefore, a heat plate or a radiant heater is not necessary. Accordingly, it is possible to increase heating efficiency and cut down a material cost.

Hereinafter, an induction heating type cooktop in some implementations will be described.

Figure 7:
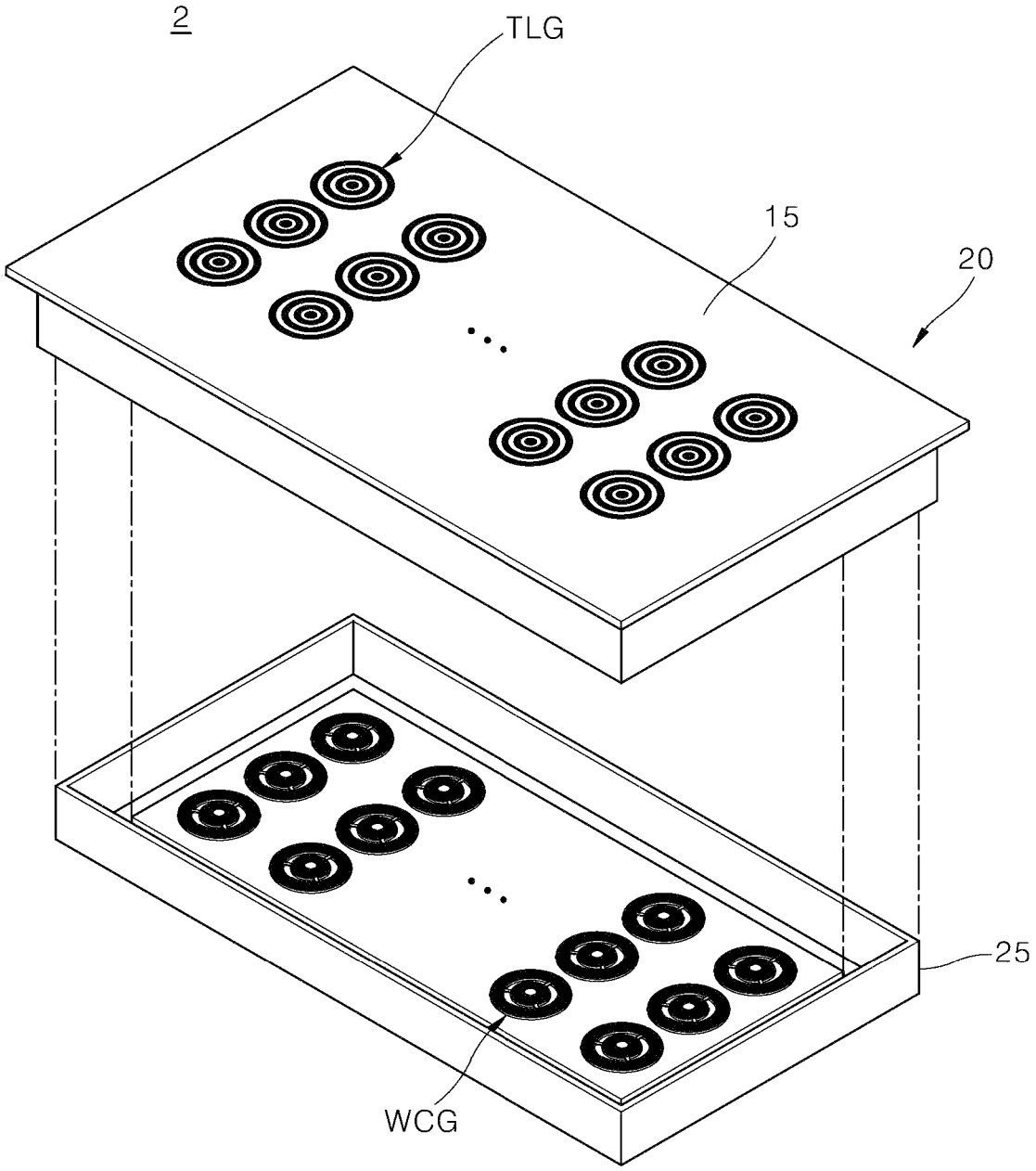
FIG. 7 is a diagram illustrating an example of an induction heating type cooktop.
Figure 8:
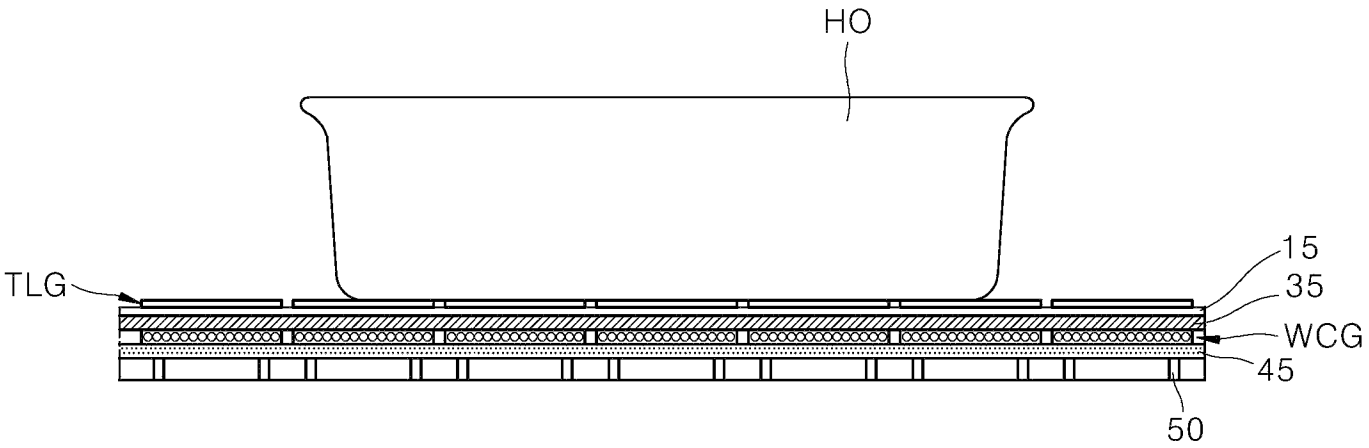
FIG. 8 is a diagram illustrating example elements disposed inside an example case of the induction heating type cooktop shown in FIG. 7.
Figure 9:
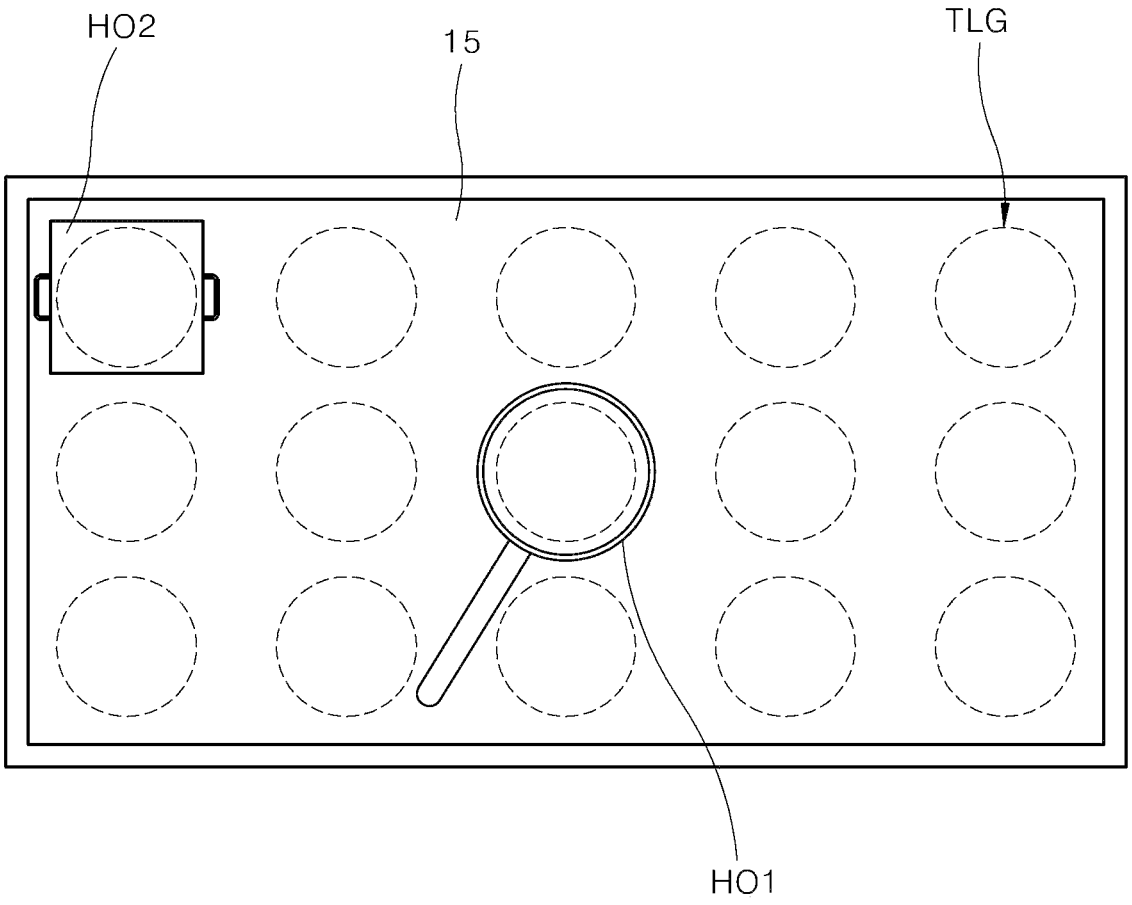
FIG. 9 is a diagram illustrating an example of a target heating object positioned on the induction heating type cooktop shown in FIG. 7.

FIG. 7 is a diagram illustrating an example of an induction heating type cooktop. FIG. 8 is a diagram illustrating example elements provided inside an example case of the induction heating type cooktop shown in FIG. 7. FIG. 9 is a diagram illustrating an example of a target heating object positioned at the induction heating type cooktop shown in FIG. 7.

An induction heating type cooktop 2 in some implementations is identical to the induction heating type cooktop 1 shown in FIG. 1, except for some elements and effects. Hence, a difference compared to the induction heating type cooktop 1 will be focused and described.

Referring to FIGS. 7 and 8, the induction heating type cooktop 2 may be a zone-free cooktop different from the induction heating type cooktop 1 shown in FIG. 1.

Specifically, the induction heating type cooktop 2 may include a case 25, a cover plate 20, a plurality of thin films TLGs, an insulator 35, a plurality of working coils WCGs, a shield plate 45, a support member 50, a cooling fan, a spacer and a control part.

Here, the plurality of thin films TLGs and the plurality of WCGs may overlap in a traverse direction and may be disposed to correspond to each other in a one-to-one relationship. The plurality of thin films TLGs and the plurality of thin films WCGs may be in a many-to-many relationship rather than the one-to-one relationship. For convenience of explanation, an example in which the plurality of thin films TLGs and the plurality of working coils WCGs are arranged in a one-to-one relationship will be described.

In some examples, the induction heating type cooktop 2 may be a zone-free cooktop including the plurality of thin films TLGs and the plurality of working coils WCGs, and therefore, it may be possible to heat a single target heating object HO by using some or all of the plurality of working coils WCGs at the same time or by using some or all of the plurality of thin films TLGs at the same time. In some examples, the target heating object HO may be heated by using both some or all of the plurality of working coils WCG and some or all of the plurality of thin films TLGs.

Accordingly, as shown in FIG. 9, in a region where the plurality of working coils WCG (see FIG. 8) and the plurality of thin films TLG are present (e.g., a region of the upper plate 15), it is possible to heat target heating objects HO1 and HO2, regardless of sizes, positions, and types of the target heating objects HO1 and HO2.

Figure 10:
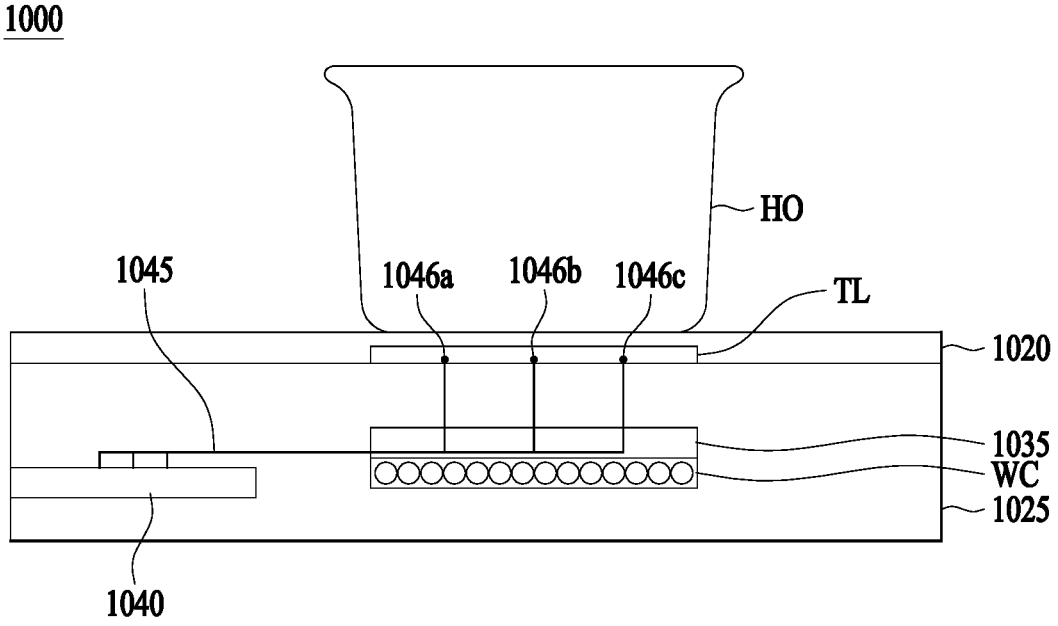
FIG. 10 illustrates an example of a cooktop having a temperature sensor to measure a temperature of a portion heated by induction heating.

FIG. 10 illustrates an example of a cooktop having a temperature sensor for measuring a temperature of a portion heated by induction heating.

In some implementations, the induction heating type cooktop 1000 described in FIG. 10 and following drawings may correspond to the induction heating type cooktop 1 used in various implementations described with reference to FIGS. 1 to 9. Hence, elements of the induction heating type cooktop 1000 not illustrated in FIG. 10 and following drawings may be understood as optionally including elements of the cooktop 1 within the scope supported by the descriptions of FIGS. 1 to 9.

Referring to FIG. 10, the induction heating type cooktop 1000 may include a cover plate 1020 coupled to the top of a case 1025 and having an upper plate 1015 allowing a target heating object HO to be placed on a top thereof, a working coil WC provided inside the case 1025 to heat the target heating object HO, a thin film TL disposed on at least one of a top and a bottom of the upper plate 1015, an insulator 1035 provided between a bottom surface of the upper plate 1015 and the working coil WC, and a temperature sensor 1045 configured to measure a temperature of at least one of the thin film TL and the upper plate 1015 using a plurality of thermocouples.

In some implementations, the temperature sensor 1045 may include the a plurality of thermocouples. Each of the thermocouples may include a first end connected with or contacting a portion at which temperature is to be measured, and a second end for transferring measurement information toward a controller. In some implementations, the temperature sensor 1045 may include some of various types of thermocouple. In some implementations, the thermocouples used in the temperature sensor 1045 may be K-type thermocouples. For instance, a K-type thermocouple may be made of nickel alloys, chrome alloys, and aluminum alloys.

In some implementations, the temperature sensor 1045 may measure an electromotive force to measure a temperature (e.g., a Seeback voltage caused by a difference in temperature between hetero metals).

For example, an electromotive force and a temperature measured using a thermocouple may correspond to each other, and data on a correlation between the electromotive force and the temperature may be stored in advance. In some implementations, the cooktop 1000 may calculate a temperature based on the electromotive force measured using a thermocouple. In some implementations, the cooktop 1000 may use the temperature sensor 1045 to measure a temperature relatively higher than a temperature that other types of temperature sensors (e.g., a thermistor) can measure. For example, the cooktop 1000 may use the temperature sensor 1045 to determine whether a temperature increases within a range at least up to 600° C. In another example, the cooktop 1000 may measure, through the temperature sensor 1045, a temperature (e.g., 500° C.) specified by a manufacturer that makes the upper plate 1015.

In some implementations, the temperature sensor 1045 may be configured to measure a temperature of at least one of the thin film TL and the upper plate 1015 using the plurality of thermocouples that are disposed to measure a temperature of a portion where a temperature is equal to or higher than a predetermined temperature in temperature distribution caused by a thin film TL being inductively heated. First ends 1046*a*, 1046*b*, and 1046*c* of the plurality of thermocouples may be disposed on at least one of the thin film TL and the upper plate 1015 to measure a heating temperature caused by the thin film TL that is inductively heated.

In some implementations, the first ends 1046*a*, 1046*b*, and 1046*c* may be disposed between the upper plate 1015 and a thin film TL disposed at the bottom of the upper plate 1015.

Figure 11:
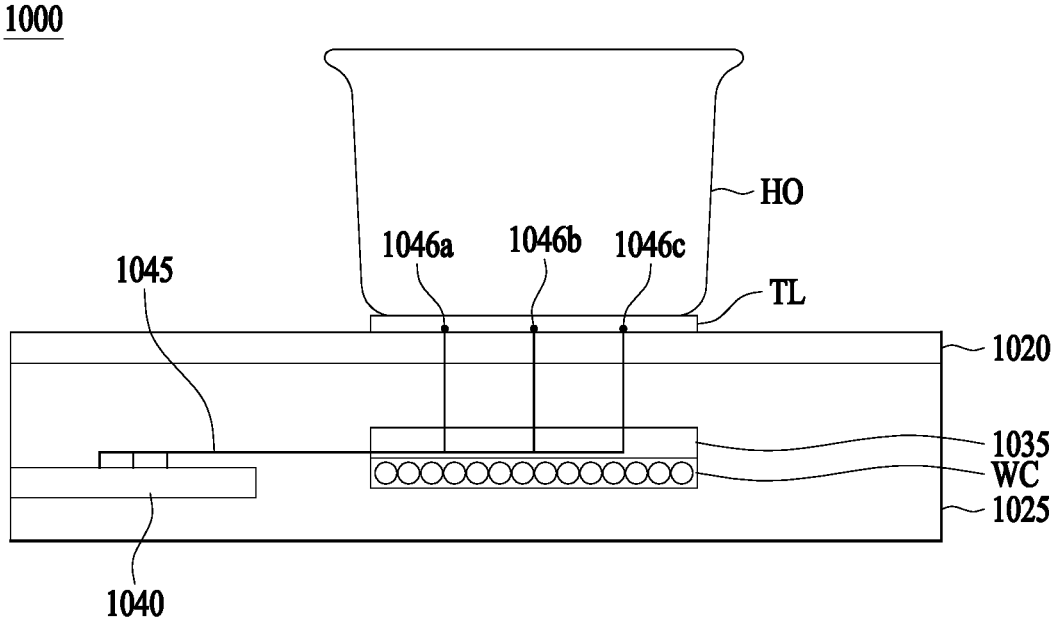
FIG. 11 illustrates an example of a cooktop having a temperature sensor to measure a temperature of a portion heated by induction heating.

FIG. 11 illustrates the cooktop 1000 having the temperature sensor 1045 to measure a temperature of a portion heated by induction heating.

In some implementations, the thin film TL of the cooktop 1000 shown in FIG. 11 may be disposed at the top of the upper plate 1015. Accordingly, the induction heated thin film TL may be brought into direct contact with a target heating object HO.

In some implementations, as the thin film TL is disposed at the top of the upper plate 1015, the first ends 1046*a*, 1046*b*, and 1046*c* of the plurality of thermocouples may be brought into contact with the thin film TL disposed at the top of the upper plate 1015. In some implementations, in order to bring the first ends 1046*a*, 1046*b*, and 1046*c* into contact with the thin film TL, the plurality of thermocouples may penetrate the upper plate 1015. In some implementations, the first ends 1046*a*, 1046*b*, and 1046*c* may be disposed in a manner of contacting the thin film TL and the upper plate 1015. That is, the first ends 1046*a*, 1046*b*, and 1046*c* may be disposed between the thin film TL and the upper plate 1015. In some implementations, the first ends 1046*a*, 1046*b*, and 1046*c* may contact the upper plate 1015 at a portion disposed at the thin film TL and measure an electromotive force caused by a temperature increased by the thin film TL.

Figure 12:
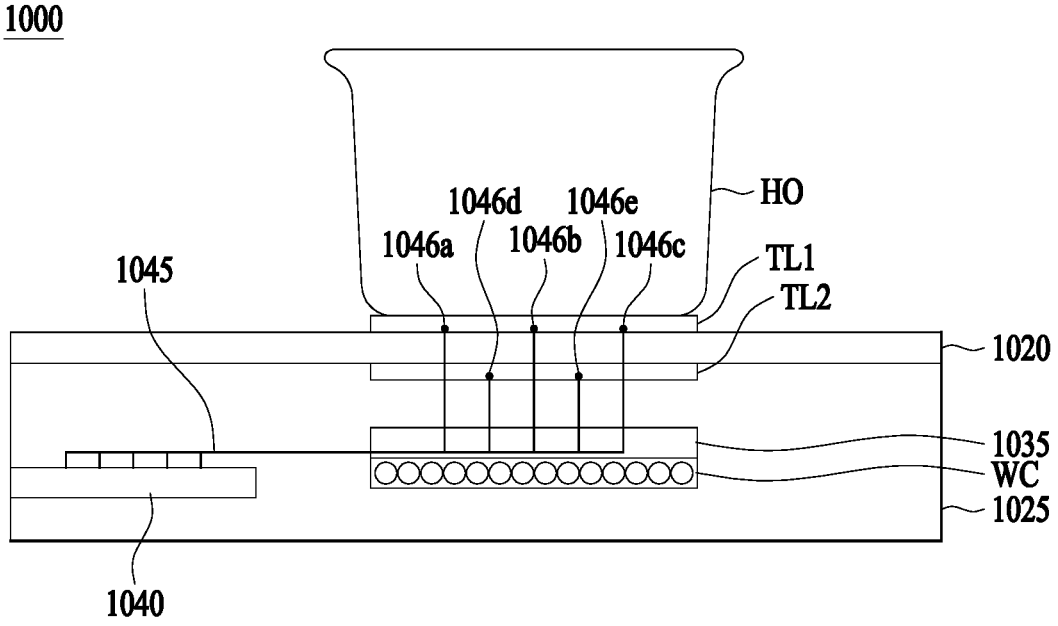
FIG. 12 illustrates an example of a cooktop having a temperature sensor to measure a temperature of a portion heated by induction heating.

FIG. 12 illustrates the cooktop 1000 having a temperature sensor to measure a temperature of a portion heated by induction heating.

In some implementations, thin films TL1 and TL2 of the cooktop 1000 shown in FIG. 12 may be disposed at a top and a bottom of the upper plate 1015. In some examples, first ends 1046*a*, 1046*b*, 1046*c*, 1046*d*, and 1046*e* of a plurality of thermocouples configured to measure temperatures of the thin films TL1 and TL2 respectively disposed at the top and the bottom of the upper plate 1015 may be located at different positions. In other examples, at least one of the first ends 1046*a*, 1046*b*, 1046*c*, 1046*d*, and 1046*e* of the plurality of thermocouples configured to measure temperatures of the thin films TL1 and TL2 respectively disposed at the top and the bottom of the upper plate 1015 may be located at the same position.

In some implementations, at least one of the first ends 1046*a*, 1046*b*, 1046*c*, 1046*d*, and 1046*e* of the plurality of thermocouples configured to measure temperatures of the thin films TL1 and TL2 respectively disposed at the top and the bottom of the upper plate 1015 may be brought into contact with the upper plate 1015 to measure a temperature increased by the thin films TL1 and TL2 that are inductively heated. In some implementations, at least one of the first ends 1046*a*, 1046*b*, 1046*c*, 1046*d*, and 1046*e* of the plurality of thermocouples configured to measure temperatures of the thin films TL1 and TL2 respectively disposed at the top and the bottom of the upper plate 1015 may be brought into contact with the thin films TL1 and TL2 to measure temperatures of the thin films TL1 and TL2 that are inductively heated.

In some implementations, at least one of the first ends 1046*a*, 1046*b*, 1046*c*, 1046*d*, and 1046*e* of the plurality of thermocouples configured to measure temperatures of the thin films TL1 and TL2 respectively disposed at the top and the bottom of the upper plate 1015 may be disposed between each of the thin films TL1 and TL2 and the upper plate 1015 to measure a temperature.

In some implementations, as an electromotive force is generated by a temperature of a target measuring part in contact with the first ends 1046*a*, 1046*b*, and 1046*c* of the plurality of thermocouples, the electromotive force may be applied to second ends. The second ends may apply the electromotive force to a board 1040 and transmit information necessary for temperature measurement to a controller.

Figure 13:
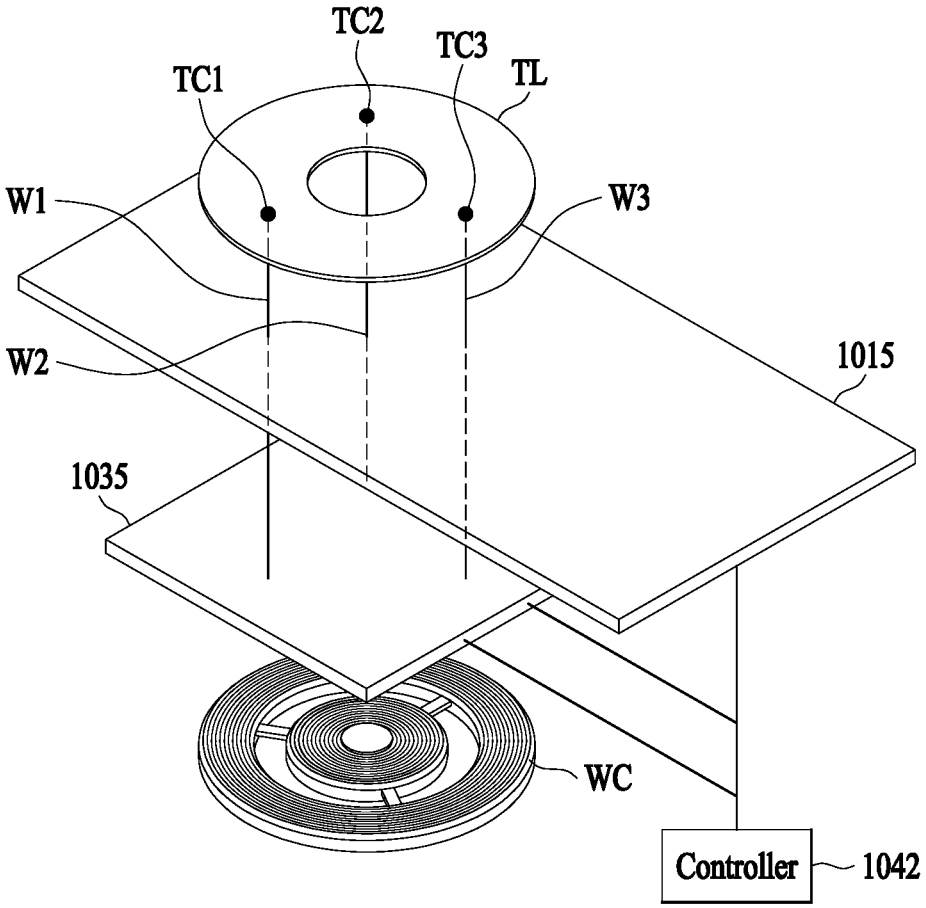
FIG. 13 illustrates an example of arrangement of a temperature sensor to measure a temperature increased by a thin film disposed at a top of an upper plate.

FIG. 13 illustrates a type of arrangement of a temperature sensor to measure a temperature increased by a thin film TL disposed at the top of the upper plate 1015.

In some implementations, first ends TC1, TC2, and TC3 of a plurality of thermocouples may be disposed in contact with a thin film TL, and a controller 1042 may measure a temperature based on an electromotive force generated by the thin film TL that is inductively heated. In some implementations, referring to FIG. 13, in order to contact the thin film TL, the plurality of thermocouples may penetrate an insulator 1035 such that the first ends TC1, TC2, and TC3 are disposed in contact with the target thin film TL.

In some implementations, in order to bring the first ends TC1, TC2, and TC3 into contact with the target thin film TL, the plurality of thermocouples may further penetrate an additional configuration (e.g., the upper plate 1015). In some implementations, the plurality of thermocouples may be provided through wires W1, W2, and W3 connected with the first ends TC1, TC2, and TC3. Data on the electromotive force applied based on temperatures of portions in contact with the first ends TC1, TC2, and TC3 may be transferred toward the controller 1042 through the wires W1, W2, and W3.

In some implementations, each of the plurality of thermocouples may be disposed in a manner of penetrating the bottom of the insulator 1035. In doing so, it is possible to prevent damage caused by the thin film TL that is heated to a high temperature.

In some implementations, the plurality of thermocouples included in the temperature sensor may be disposed to measure a temperature of a portion where a temperature is equal to or higher than a predetermined temperature in a temperature distribution caused by the thin film TL being inductively heated. In some implementations, the thin film TL may be inductively heated by a magnetic field occurring in the working coil WC, and heat distribution in the inductively heated thin film TL may change in a radial direction. In some implementations, a portion to be heated to the highest temperature in the inductively heated thin film TL may be determined based on a dispositional relation with the working coil WC, and the first ends TC1, TC2, and TC3 may be disposed at the portion to be heated to the highest temperature in the thin film TL. For example, when the thin film TL is inductively heated, a central portion of the thin film TL with reference to a radial direction may be heated to the highest temperature and the first ends TC1, TC2, and TC3 may be disposed at the central portion of the thin film TL.

In some implementations, the first ends TC1, TC2, and TC3 may be disposed at a predetermined interval on the thin film TL.

Figure 14:
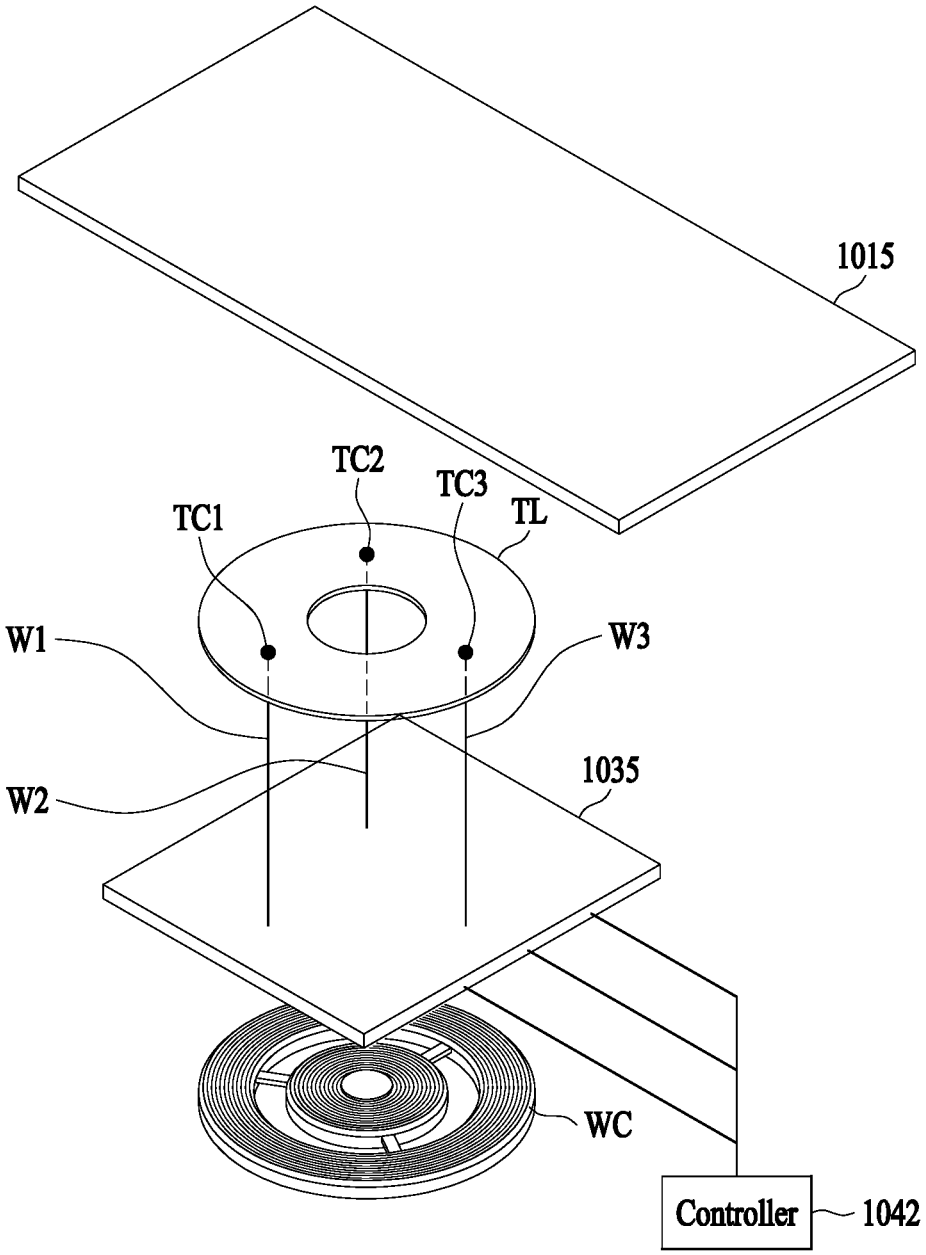
FIG. 14 illustrates an example of arrangement of a temperature sensor to measure a temperature increased by a thin film TL disposed at a bottom of an upper plate.

FIG. 14 illustrates an example of arrangement of a temperature sensor to measure a temperature increased by a thin film TL disposed at the bottom of the upper plate 1015.

In some implementations, first ends TC1, TC2, and TC3 of a plurality of thermocouples may be disposed in contact with a thin film TL, and the controller 1042 may measure a temperature based on an electromotive force generated by the thin film TL that is inductively heated. In some implementations, referring to FIG. 14, in order to contact the target thin film TL, the plurality of thermocouples may penetrate the insulator 1035 such that the first ends TC1, TC2, and TC3 are disposed in contact with the target thin film TL. Data on an electromotive force applied based on the temperature of portions in contact with the first ends TC1, TC2, and TC3 may be transferred toward the controller 1042 through wires W1, W2, and W3.

Figure 15:
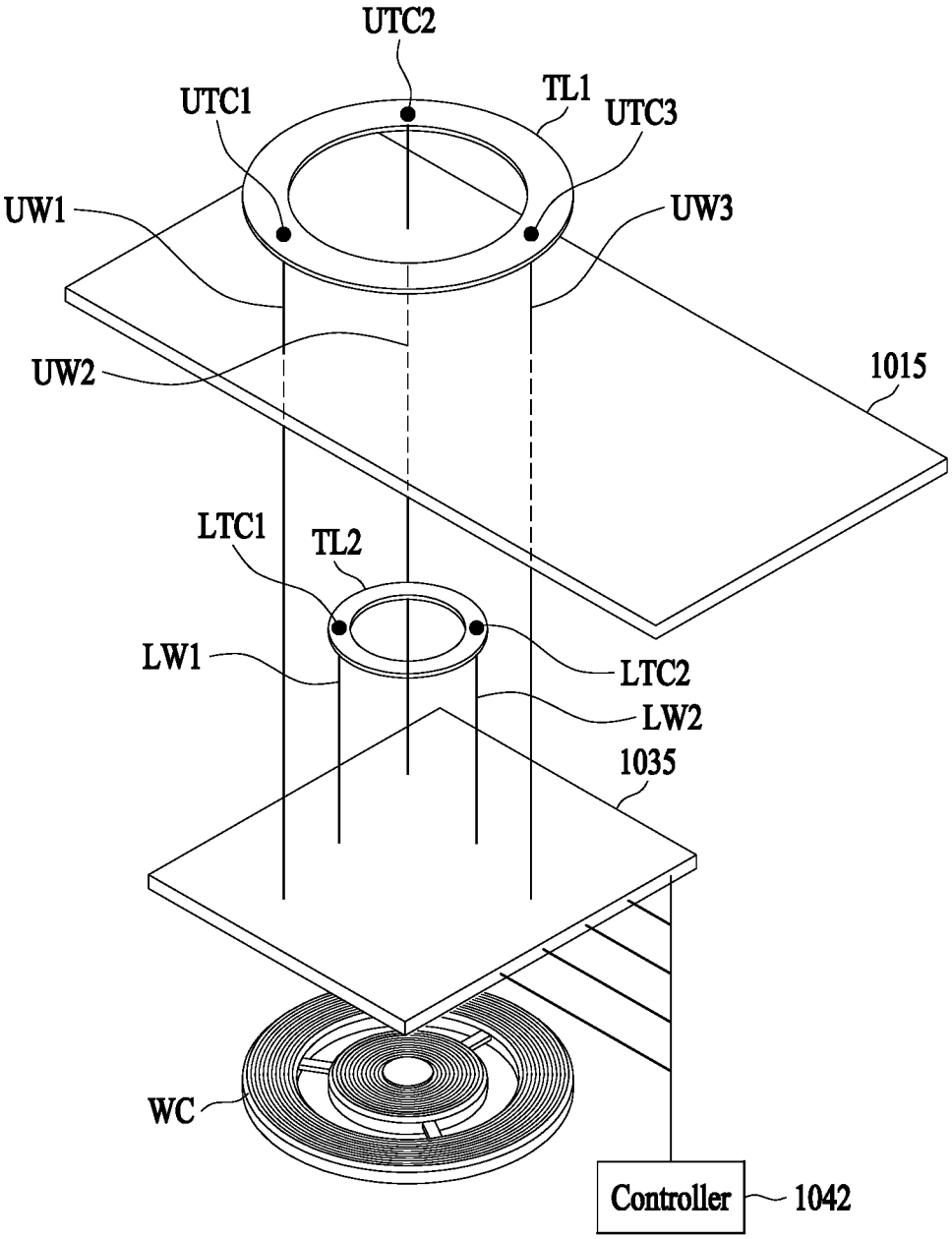
FIG. 15 illustrates an example of arrangement of a temperature sensor to measure a temperature increased by thin films disposed at the top and a bottom of an upper plate.

FIG. 15 illustrates an example of arrangement of a temperature sensor to measure a temperature increased by thin films disposed at the top and the bottom of the upper plate.

Referring to FIG. 15, first ends UTC1, UTC2, UTC3, LTC1, and LTC2 of a plurality of thermocouples may be disposed in contact with thin films TL1 and TL2 disposed at the top and the bottom of the upper plate 1015, and the controller 1042 may measure a temperature based on an electromotive force generated by the thin films TL1 and TL2 that are inductively heated. In some implementations, referring to FIG. 15, in order to contact the thin film TL1 disposed at the top of the upper plate 1015, the plurality of thermocouples may penetrate the insulator 1035 and the upper plate 1015 to bring the first ends UTC1, UTC2, and UTC3 into contact with the target thin film TL1 corresponding to a target measuring part, and the thermocouples may penetrate the insulator 1035 to bring the first ends LTC1 and LTC2 into contact with the thin film TL2 corresponding to a target measuring part.

In some implementations, the respective thermocouples may be provided through wires UW1, UW2, and UW3 connected with the first ends UTC1, UTC2, and UTC3. Data on an electromotive force applied based on a temperature of portions in contact with the first ends UTC1, UTC2, and UTC3 may be transferred toward the controller 1042 through the wires UW1, UW2, and UW3. In some implementations, the respective thermocouples may be provided through wires LW1, and LW2 connected with the first ends LTC1, and LTC2. Data on an electromotive force applied based on a temperature of portions in contact with the first ends LTC1, and LTC2 may be transferred toward the controller 1042 through the wires LW1, and LW2.

In some implementations, the thin films TL1 and TL2 disposed at the top and the bottom of the upper plate 1015 may be different in terms of shape and number.

In some implementations, each of the thin films TL1 and TL2 disposed at the top and the bottom of the upper plate 1015 may be in a ring shape having a different inner or outer radius. For example, the thin films TL1 and TL2 may have concentric ring shapes. In some examples, each of the thin films TL1 and TL2 disposed at the top and the bottom of the upper plate 1015 may be in a disc shape having no hole formed at the center thereof.

In some implementations, each of the thin films TL1 and TL2 disposed at the top and the bottom of the upper plate 1015 may include a plurality of sub-thin films, and the plurality of sub-thin films may have different inner or outer radiuses and disposed at the top or the bottom of the upper plate 1015. In some implementations, the plurality of sub-thin films may be spaced apart from each other and thus have a gap therebetween. In some implementations, the thin films TL1 and TL2 disposed at the top and the bottom of the upper plate 1015 may be disposed at positions overlapping each other.

In some implementations, portions to be heated to a highest temperature in the thin films TL1 and TL2 may be determined based on a dispositional relationship with a working coil WC. Accordingly, the first ends UTC1, UTC2, and UTC3 may be disposed at the portions to be inductively heated to the highest temperature in the thin film TL1 disposed at the top of the upper plate 1015, and the first ends LTC1 and LTC2 may be disposed at the portions to be inductively heated to the highest temperature in the thin film TL2 disposed at the bottom of the upper plate 1015.

Figure 16:
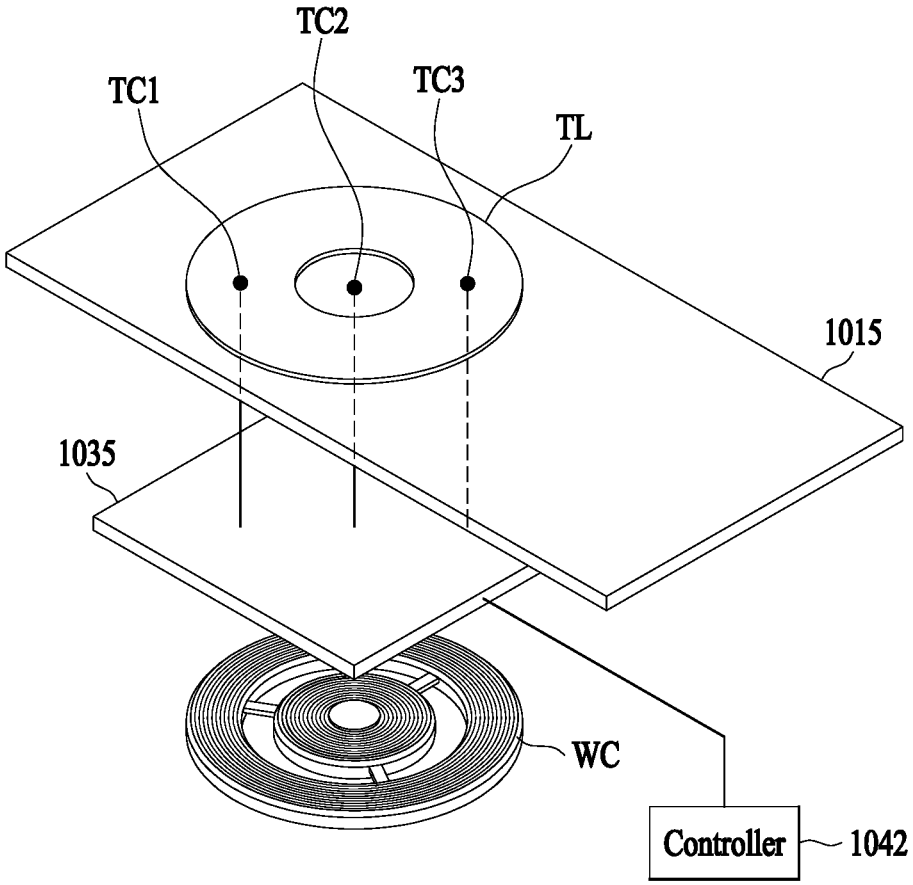
FIG. 16 illustrates an example of arrangement of thermocouples for measuring temperatures of a thin film and an upper plate.

FIG. 16 illustrates example thermocouples that measure temperatures of a thin film and an upper plate.

In some implementations, as illustrated in FIGS. 10 to 15, a plurality of thermocouples may be disposed in a region where a thin film TL is positioned. Accordingly, first ends (e.g., first ends 1046*a*, 1046*b*, and 1046*c*) may be in contact with at least one of the inductively heated thin film TL and the upper plate 1015. In this case, the region where the thin film TL is positioned may be understood as a region included in an area where the thin film TL is disposed, as viewed vertically above from the upper plate 1015.

Referring to FIG. 16, in some implementations, at least one of the thermocouples may be disposed in a region where the thin film TL is positioned, and at least one of remaining thermocouples may be disposed at a region where the thin film TL is not positioned. That is, among the plurality of thermocouples, first ends TC1 and TC3 disposed at the point where the thin film TL is positioned may be disposed in contact with at least one of the upper plate 1015 and the thin film TL and may transfer an electromotive force caused by a heating temperature toward the controller 1042, whilst a first end TC2 disposed at the point where the thin film TL is not positioned may be disposed in contact with the upper plate 1015 and may transfer an electromotive force caused by a heating temperature toward the controller 1042.

In some implementations, the first end TC2 disposed at the portion where the thin film TL is not positioned may be disposed at a hole formed at the central portion of the thin film TL. In some implementations, the thin film TL may include a plurality of sub-thin films disposed to have a gap therebetween, and the first end TC2 may be disposed in the gap between the sub-thin films.

However, arrangement or shape of elements of the cooktop 1000 in FIGS. 10 to 16 are merely exemplary for convenience of explanation, and aspects of the present disclosure are not limited thereto. Other various arrangements and shapes are possible, including an example in which a plurality of thermocouples are disposed in at least one of a thin film and an upper plate.

Figure 17:
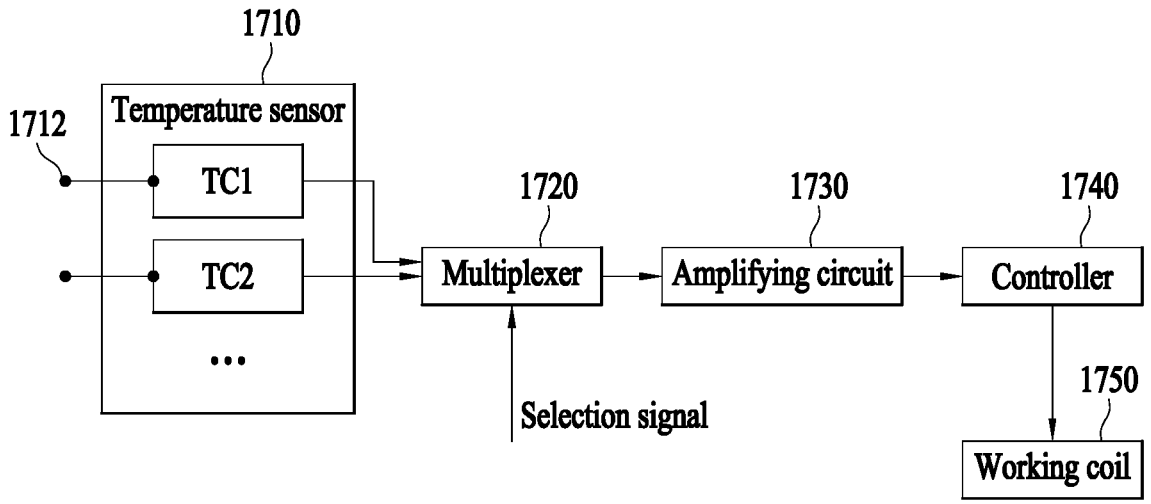
FIG. 17 is a block diagram illustrating an example controller that controls a working coil based on a temperature of a thin film that is measured by one or more of a plurality of thermocouples based on a selection signal.

FIG. 17 is a block diagram illustrating an example of a controller that controls a working coil based on a measured temperature dependent on information that is measured by one or more of a plurality of thermocouples based on a selection signal.

In some implementations, a temperature sensor 1710 may include a plurality of thermocouples TC1, TC2, etc., and an electromotive force caused by a target measuring part in contact with first ends 1712 and the like of the plurality of thermocouples TC1 and TC2 may be transferred to a multiplexer 1720. The electromotive force transferred to the multiplexer 1720 may be transferred in a predetermined data format, and an electromotive force in the format of an analog signal may be transmitted directly.

Based on a received selection signal, the multiplexer 1720 may transfer one of electromotive forces, obtained in a predetermined cycle from the plurality of thermocouples, to an amplifying circuit 1730. In some implementations, the selection signal may be a signal to select one of input signals corresponding to the electromotive forces obtained from the plurality of thermocouples TC1 and TC2, and the selection signal may enable selection of one of electromotive forces obtained in the predetermined cycle from the plurality of thermocouples TC1 and TC2. In some implementations, the selection signal may correspond to a signal received from an outside (e.g., a signal input by a user).

In some examples, the multiplexer 1720 may include an electric device, an electric circuit, a processor, a microprocessor, or the like.

In some implementations, the amplifying circuit 1730 may be a circuit to amplify an electromotive force acquired from the multiplexer 1720. In some implementations, even when the electromotive force acquired from the multiplexer 1720 does not vary greatly compared to a variation of temperature, the amplifying circuit 1730 for amplifying the magnitude of the electromotive force may be used in order to easily a measure temperature based on a variation of the electromotive force.

In some implementations, the amplifying circuit 1730 may be a single circuit, regardless of the number of the plurality of thermocouples TC1 and TC2. For example, the cooktop 1000 may use the multiplexer 1720 to select one of electromotive forces acquired from the plurality of thermocouples TC1 and TC2, and it may measure a temperature by the single amplifying circuit 1730. Accordingly, even when a temperature is measured at multiple points, the single amplifying circuit 1730 may be used, and therefore, complexity of circuit configuration may be reduced and a space saving may be achieved.

In some examples, the amplifying circuit 1730 may be configured as a plurality of amplifying circuits. For example, a specific configuration of the amplifying circuit 1730 may be understood as including various circuits, which are capable of amplifying and outputting an input electromotive force.

In some implementations, having acquired an electromotive force signal output through the amplifying circuit 1730, the controller 1740 may measure a temperature based on an electromotive force. By measuring a temperature based on the electromotive force, the controller 1740 may be capable of controlling an output of a working coil 1750. A detailed description thereof will be provided in the following.

In some implementations, the controller 1740 may include an electric circuit, one or more processors, a microprocessor, etc.

Figure 18:
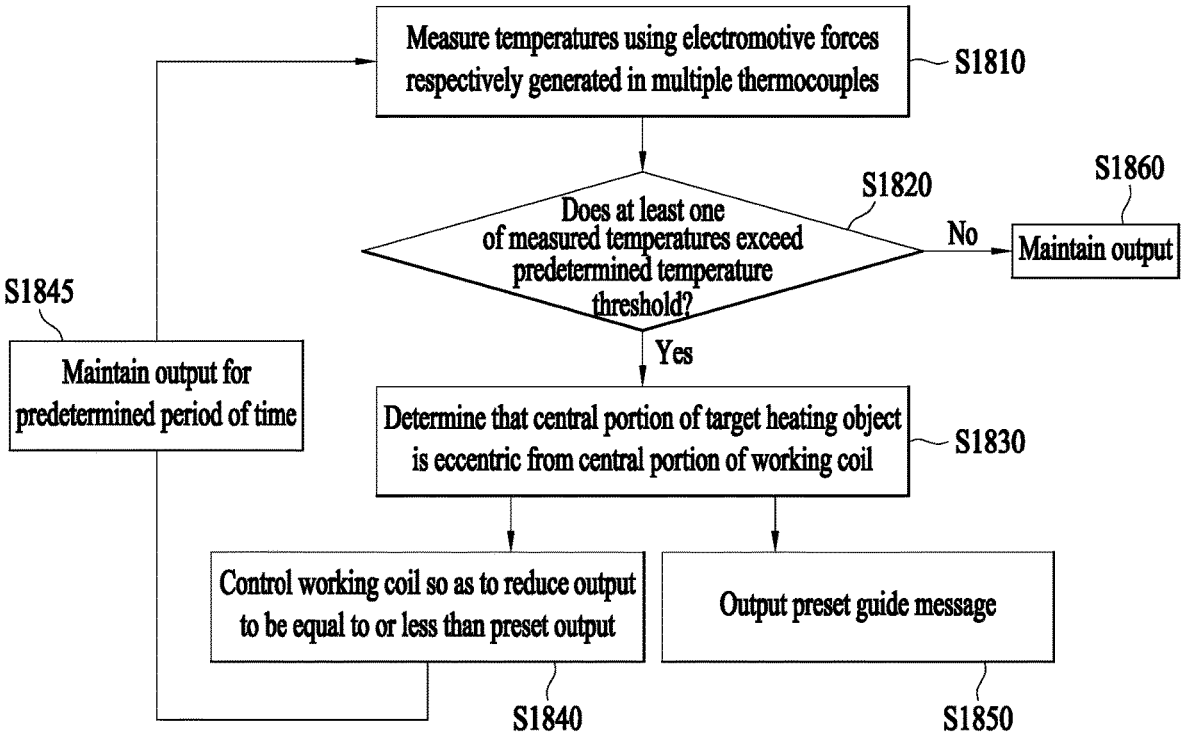
FIG. 18 is a flowchart illustrating an example of a method for controlling an output based on whether a temperature measured using each of a plurality of thermocouples exceeds a temperature threshold.

FIG. 18 is a flowchart illustrating an example method for controlling an output based on whether a temperature measured using each of a plurality of thermocouples exceeds a temperature threshold.

For example, the cooktop 1000 may measure a temperature based on electromotive forces generated in the plurality of thermocouples in operation S1810.

In operations S1820, the cooktop 1000 may determine whether at least one of temperatures measured through the electromotive forces generated in the plurality of thermocouples exceeds a predetermined temperature threshold. In some implementations, a thin film TL inductively heated by a working coil WC may form an equivalent circuit to that of a magnetic target heating object HO, the equivalent circuit having a resistance component and an inductor component. In some implementations, when the target heating object HO is eccentric from the thin film TL and the center of the working coil WC, the temperature of the induction-heated thin film TL may greatly increase at the portion where the object to be heated deviates from the thin film TL. Accordingly, the temperature measured at some of the plurality of thermocouples may exceed the predetermined temperature threshold.

In some implementations, when it is determined that at least one measured temperature does not exceed the predetermined temperature threshold, the cooktop 1000 may maintain the current output, in operation S1860. In some implementations, rather than maintaining the current output, the cooktop 1000 may control the working coil WC to output an output set by a user.

In some implementations, when it is determined that at least one of measured temperatures exceeds the predetermined temperature threshold, the cooktop 1000 may determine that a central portion of the target heating object HO is eccentric from a central portion of the working coil WC, in operation S1830. For example, the controller 1740 may determine that a center point of a bottom surface of the target heating object HO is radially offset (e.g., spaced apart) from a position corresponding to a center point of the working coil WC based on at least one of measured temperatures exceeding the predetermined temperature threshold.

In some implementations, when it is determined that the central portion of the target heating object HO is eccentric from the central portion of the working coil WC, the cooktop 1000 may control the working coil WC so as to reduce an output to a preset output or below, in operation S1840. In some implementations, in order to prevent damage to the upper plate 1015 and other elements caused by rapid increase in temperature when the thin film TL is inductively heated due to eccentricity of the target heating object HO, the controller 1740 may control the working coil WC so as to reduce an output to the preset output or below. In some implementations, the preset output may be an output lower by a specific degree than an output set by a user or may be a specific absolute output.

In some implementations, the cooktop 1000 may further include an output part to allow a user to be aware of specific information. The output part may produce an output that is visible, audible, tactile, etc. The output part may include a display to output visible information, a speaker for outputting audible information, a haptic part for outputting tactile information, and the like.

In some implementations, when it is determined that the central portion of the target heating object HO is eccentric from the central portion of the working coil WC, the working coil WC may be controlled to reduce an output to a preset output or below and may optionally output a preset guide message in operation S1850. In some implementations, the guide message may be visually or audibly output. In some implementations, the guide message output in operation S1850 may include information to inform a user of the fact that the target heating object HO is eccentric or that an output is reduced due to eccentricity of the target heating object HO.

In some implementations, after operation S1840 in which the working coil WC is controlled to reduce an output to the preset output or below, the cooktop 1000 may maintain the reduced output for a predetermined period of time, in operation S1845. In some implementations, after the predetermined period of time elapses, the cooktop 1000 may return back to operation S1810 to measure a temperature based on the electromotive forces respectively generated in the plurality of thermocouples. In some implementations, the cooktop 1000 may determine again whether a temperature measured based on an output maintained for the predetermined period of time exceeds the predetermined temperature threshold in operation S1820.

Accordingly, the cooktop 100 may constantly reduce the output until a measured temperature to the predetermined temperature threshold or below, thereby preventing damage of the upper plate 1015 and the like. At the same time, the cooktop 1000 may output a preset guide message to a user so as to inform the user of the fact that the target heating object HO is eccentric and being heated using an output lower than an output set by the user, so that the user can place the eccentric target heating object HO to its right position and thus the cooktop 1000 may be heated again using an appropriate output.

Figure 19:
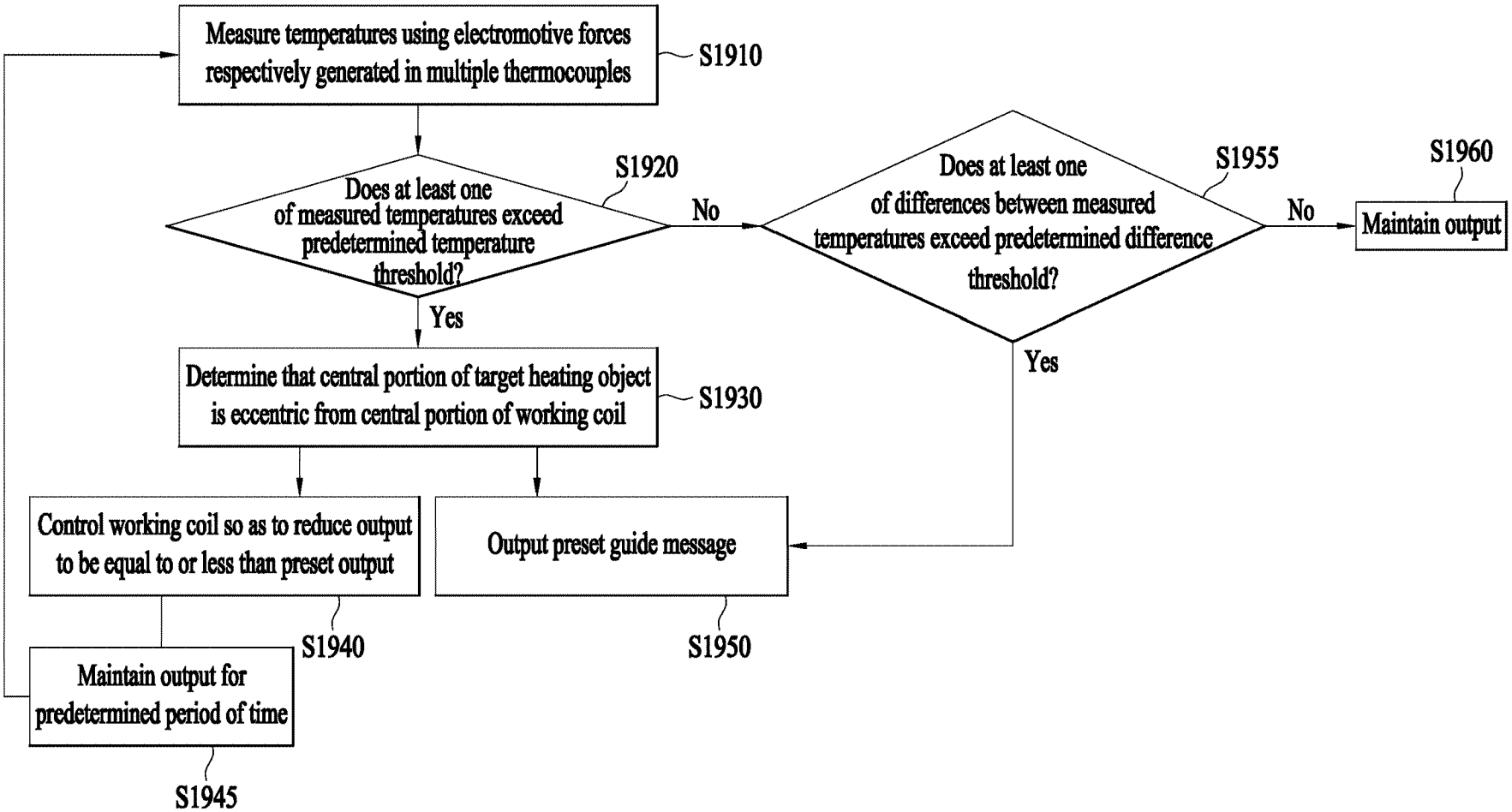
FIG. 19 is a flowchart illustrating an example of a method for controlling an output based on whether a temperature measured using each of a plurality of thermocouples exceeds a predetermined temperature threshold and based on whether at least one of differences between temperatures measured by the a plurality of thermocouples exceeds a predetermined difference threshold.

FIG. 19 is a flowchart illustrating an example method for controlling an output in accordance with whether a temperature measured using each of a plurality of thermocouples exceeds a predetermined temperature threshold and based on whether at least one of differences between temperatures measured by the plurality of thermocouples exceeds a predetermined difference threshold. In some examples, characteristics of operations S1910, S1920, S1930, S1940, and S1945 in FIG. 19 may be identical or similar to characteristics of operations S1810, S1820, S1830, S1840, and S1845, and thus, a detailed description thereof will be herein omitted.

In some implementations, when it is determined in operation S1920 that at least one of temperatures measured based on electromotive forces respectively generated in the plurality of thermocouples does not exceed a predetermined temperature threshold, the cooktop 1000 may determine at least one of differences between temperatures measured by the plurality of thermocouples exceeds a predetermined difference threshold in operation S1955. In some implementations, in response to a determination made in operation S1930 that the target heating object HO is eccentric, when a working coil WC is controlled in operation S1940 and accordingly an output is constantly reduced, a measured temperature may be reduced to a predetermined temperature threshold or below despite the eccentricity of the target heating object HO.

In some implementations, when the target heating object HO is eccentric, it is not possible to properly heat the target heating object HO using an output set by a user and therefore heating efficiency may be degraded. Accordingly, even in the case where a measured temperature is equal to or lower than the predetermined temperature threshold, if at least one of differences between temperatures measured by the plurality of thermocouples exceeds the predetermined temperature threshold, the cooktop 1000 may output a preset guide message to the user through an output part in operation S1950. In some implementations, the guide message output in operation S1950 may include information to inform the user of the fact that the target heating object HO is eccentric.

In some implementations, when it is determined that a measured temperature is equal to or lower than the predetermined temperature threshold and that at least one of differences between temperatures measured by the plurality of thermocouples is equal to or lower than the predetermined difference threshold, the cooktop 1000 may maintain the current output, in operation S1960. In some implementations, rather than maintaining the current output, the cooktop 1000 may control the working coil WC to output an output set by the user.

In some implementations, it is possible to heat both a magnetic object and a nonmagnetic object at a single induction fire hole by using a thin film capable of being directly inductively heated.

In some implementations, it is possible to rapidly and precisely measure a high temperature occurring in a cooktop having a thin film that is inductively heated to the high temperature.

It is possible to prevent a damage of an upper plate of the cooktop caused by the thin film heated to the high temperature.

In some implementations, in a cooktop capable of rapidly heating a magnetic object and a nonmagnetic object in an induction heating method, it is possible to measure a high temperature and control an output so as to prevent a damage of an upper plate caused by an abnormal high temperature that occurs when a target heating object is eccentric.

In addition to the aforementioned effects, other specific effects have been described above with reference to the foregoing implementations of the present disclosure.

The foregoing description of the present disclosure is not limited to the aforementioned implementations and the accompanying drawings, and it will be obvious to those skilled in the technical field to which the present disclosure pertains that various substitutions, modifications, and changes may be made within the scope without departing from the technical spirit of the present disclosure.

What is claimed is:

1. An induction heating type cooktop, comprising:

an upper plate coupled to a top side of a case and configured to place an object to be heated on a top of the upper plate;

a thin film disposed on at least one of a top surface or a bottom surface of the upper plate;

a working coil disposed inside the case and configured to inductively heat at least one of the object or the thin film;

an insulator disposed between the bottom surface of the upper plate and the working coil; and a temperature sensor configured to measure a temperature of at least one of the thin film or the upper plate by a plurality of thermocouples, wherein a thickness of the thin film is less than a skin depth of the thin film.

2. The induction heating type cooktop of claim 1, wherein the temperature sensor is further configured to measure a first temperature of a portion of the at least one of the thin film or the upper plate, and wherein the temperature sensor is disposed at a central portion of the thin film with reference to a radial direction of the thin film.

3. The induction heating type cooktop of claim 2, wherein the plurality of thermocouples are disposed at regions corresponding to the thin film on the at least one of the top surface or the bottom surface of the upper plate.

4. The induction heating type cooktop of claim 2, wherein the plurality of thermocouples comprise:

at least one thermocouple that is disposed at a region corresponding to the thin film and that is configured to measure the temperature of the thin film; and at least one thermocouple that is disposed at a region outside the thin film.

5. The induction heating type cooktop of claim 1, further comprising a controller configured to control the working coil, wherein each of the plurality of thermocouples comprises:

a first end that is connected to the at least one of the thin film or the upper plate, and a second end that is configured to transfer an electromotive force to the controller.

6. The induction heating type cooktop of claim 5, wherein the first end passes through the insulator and is attached to the at least one of the thin film or the upper plate.

7. The induction heating type cooktop of claim 5, wherein the controller is configured to measure a temperature of a thermocouple that is selected among the plurality of thermocouples based on a selection signal.

8. The induction heating type cooktop of claim 7, further comprising:

a multiplexer that is configured to receive the selection signal, that is configured to select the thermocouple based on the selection signal, and that is configured to switch selection of the thermocouple among the plurality of thermocouples based on a predetermined cycle; and an amplifying circuit configured to amplify the electromotive force generated in the thermocouple that is selected by the multiplexer, wherein the controller is further configured to receive information regarding the temperature of the selected thermocouple through the amplifying circuit.

9. The induction heating type cooktop of claim 5, wherein the controller is further configured to control an output of the working coil based on whether at least one of temperatures measured by the plurality of thermocouples exceeds a predetermined temperature threshold.

10. The induction heating type cooktop of claim 9, wherein the controller is further configured to, based on the at least one of the temperatures exceeding the predetermined temperature threshold, determine that a central portion of the object is offset from a central portion of the working coil.

11. The induction heating type cooktop of claim 10, wherein the controller is further configured to:

based on a determination that the central portion of the object is offset from the central portion of the working coil, control the output of the working coil to be less than or equal to a preset output.

12. The induction heating type cooktop of claim 11, wherein the controller is further configured to:

based on the at least one of the temperatures being less than or equal to the predetermined temperature threshold, maintain the output of the working coil.

13. The induction heating type cooktop of claim 10, wherein the controller is further configured to output a predetermined guide message based on a determination that the central portion of the object is offset from the central portion of the working coil.

14. The induction heating type cooktop of claim 13, wherein the controller is further configured to:

determine whether at least one of differences between the temperatures measured by the plurality of thermocouples exceeds a predetermined difference threshold; and output the predetermined guide message based on a determination that at least one of differences between the temperatures measured by the plurality of thermocouples exceeds the predetermined difference threshold.

15. The induction heating type cooktop of claim 1, wherein the plurality of thermocouples are K-type thermocouples.

16. The induction heating type cooktop of claim 1, wherein the thin film has a ring shape having a central area that exposes the upper plate, and wherein the plurality of thermocouples comprise a first thermocouple connected to the thin film and a second thermocouple connected to the upper plate corresponding to the central area of the thin film.

17. The induction heating type cooktop of claim 16, wherein each of the first thermocouple and the second thermocouple passes through the insulator.

18. The induction heating type cooktop of claim 1, wherein the thin film comprises a first thin film attached to the top surface of the upper plate and a second thin film attached to the bottom surface of the upper plate, wherein the thickness is a thickness of one of the first thin film or the second thin film, wherein the skin depth is a skin depth of the one of the first thin film or the second thin film, and wherein the plurality of thermocouples comprise an upper thermocouple connected to the first thin film and a lower thermocouple connected to the second thin film.

19. The induction heating type cooktop of claim 18, wherein the first thin film and the second thin film have concentric ring shapes having different diameters, and wherein each of the upper thermocouple and the lower thermocouple passes through the insulator.

20. An induction heating type cooktop, comprising:

an upper plate coupled to a top side of a case and configured to place an object to be heated on a top of the upper plate;

a working coil disposed inside the case to heat the object;

a first thin film attached to a top surface of the upper plate;

a second thin film attached to a bottom surface of the upper plate;

an insulator disposed between the bottom surface of the upper plate and the working coil; and a temperature sensor configured to measure a temperature of at least one of the first thin film, the second thin film, or the upper plate by a plurality of thermocouples, wherein the plurality of thermocouples comprise an upper thermocouple connected to the first thin film and a lower thermocouple connected to the second thin film.

* * * * *